US012559883B2

(12) United States Patent
Jang et al.

(10) Patent No.: US 12,559,883 B2
(45) **Date of Patent: *Feb. 24, 2026**

(54) LAUNDRY TREATMENT APPARATUS AND METHOD OF CONTROLLING THE SAME

(71) Applicant: LG Electronics Inc., Seoul (KR)

(72) Inventors: Semin Jang, Seoul (KR); Jaehyung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 145 days.

This patent is subject to a terminal disclaimer.

(21) Appl. No.: 18/259,933

(22) PCT Filed: Dec. 30, 2021

(86) PCT No.: PCT/KR2021/020239
§ 371 (c)(1),
(2) Date: Jun. 29, 2023

(87) PCT Pub. No.: WO2022/146063
PCT Pub. Date: Jul. 7, 2022

(65) Prior Publication Data

US 2024/0167217 A1 May 23, 2024

(30) Foreign Application Priority Data

Dec. 31, 2020 (KR) ..... 10-2020-0189128

(51) Int. Cl.
*D06F 63/02* (2006.01)
*D06F 67/00* (2006.01)
(Continued)

(52) U.S. Cl.
CPC ..... *D06F 63/02* (2013.01); *D06F 67/005* (2013.01); *D06F 67/02* (2013.01); *D06F 71/29* (2013.01); *D06F 71/34* (2013.01)

(58) Field of Classification Search
CPC ..... D06F 73/00; D06F 58/10; D06F 87/00; D06F 63/00; D06F 63/02; D06F 67/005;
(Continued)

(56) References Cited

U.S. PATENT DOCUMENTS 1,593,597 A * 7/1926 Potter ..... D06F 65/08 38/59
2015/0020419 A1 1/2015 Park et al.
(Continued)

FOREIGN PATENT DOCUMENTS

CN 111895737 A 11/2020
KR 10-2011- 0048343 5/2011
(Continued)

OTHER PUBLICATIONS

English translation of Coway Co. (KR 20200081084), found through https://worldwide.espacenet.com, Jul. 7, 2020.*
(Continued)

*Primary Examiner* — Alissa J Tompkins
(74) *Attorney, Agent, or Firm* — Fish & Richardson P.C.

(57) ABSTRACT

The present disclosure relates to a laundry treatment apparatus including a cabinet having an entrance formed in one surface thereof, a first chamber, which is positioned in the cabinet and receives laundry therein through the entrance, a second chamber, which is positioned below the first chamber and defines a space isolated from the first chamber, a door having a mount space defined therein and rotatably coupled to the cabinet so as to open and close the entrance, a door inner plate facing the entrance, and a roller-type press unit, which is coupled to the door inner plate so as to press suspended pants and removes wrinkles from the pants, wherein power is supplied to the press unit through the interior space of the door.

22 Claims, 10 Drawing Sheets

(51) Int. Cl.
*D06F 67/02* (2006.01)
*D06F 71/29* (2006.01)
*D06F 71/34* (2006.01)

(58) Field of Classification Search
CPC ..... D06F 67/02; D06F 67/10; D06F 65/00; D06F 65/02; D06F 65/08; D06F 71/36
See application file for complete search history.

(56) References Cited

U.S. PATENT DOCUMENTS

| | | | | |
|---|---|---|---|---|
| 2016/0201253 | A1 | 7/2016 | Kulkarni et al. | |
| 2018/0340291 | A1* | 11/2018 | Kim | D06F 73/00 |

FOREIGN PATENT DOCUMENTS

| | | | |
|---|---|---|---|
| KR | 10-1220579 | | 1/2013 |
| KR | 10-2018-0083740 | | 7/2018 |
| KR | 10-2099179 | | 4/2020 |
| KR | 10-2020-0081084 | | 7/2020 |
| KR | 10-2020-0081146 | | 7/2020 |
| KR | 10-2020-0141302 | A | 12/2020 |
| WO | WO 2020/084315 | A1 | 4/2020 |

OTHER PUBLICATIONS

English translation of LG Electronics (KR 20180083740), found through https://worldwide.espacenet.com, Jul. 23, 2018.*
Extended European Search Report in European Appln. No. 21915860.7, mailed on Oct. 16, 2024, 7 pages.
International Search Report and Written Opinion in International Appln. No. PCT/KR2021/020239, mailed on Apr. 27, 2022, 11 pages.
Action in Korean Appln. No. 10-2020-0189128, mailed on May 16, 2025, 7 pages (Official Copy Only).

* cited by examiner

[Fig. 1] Related Art
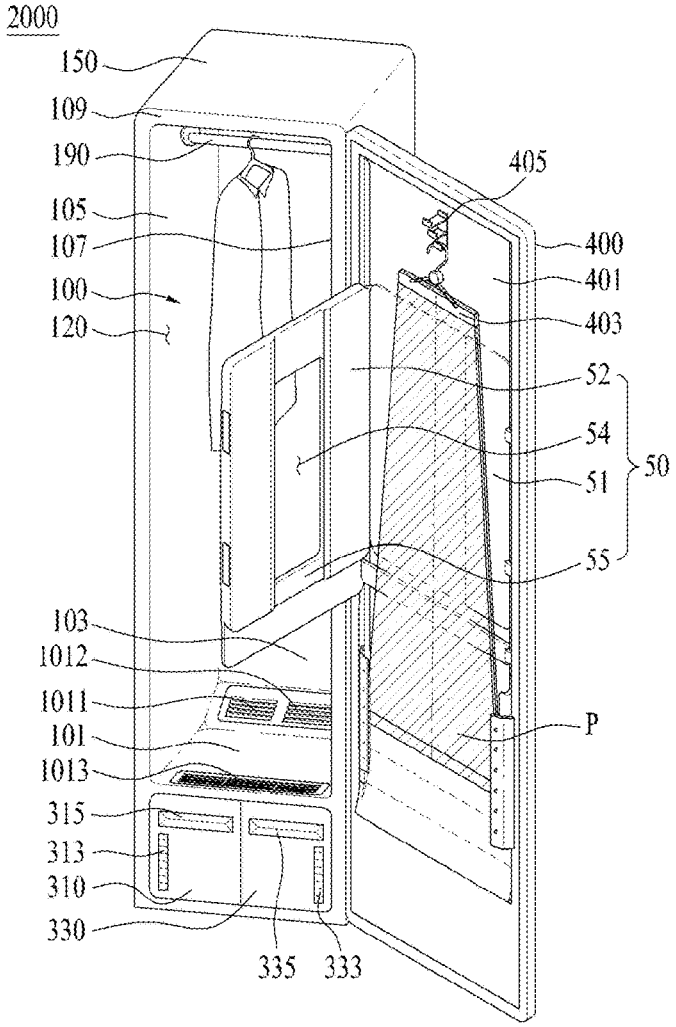
[Fig. 2]
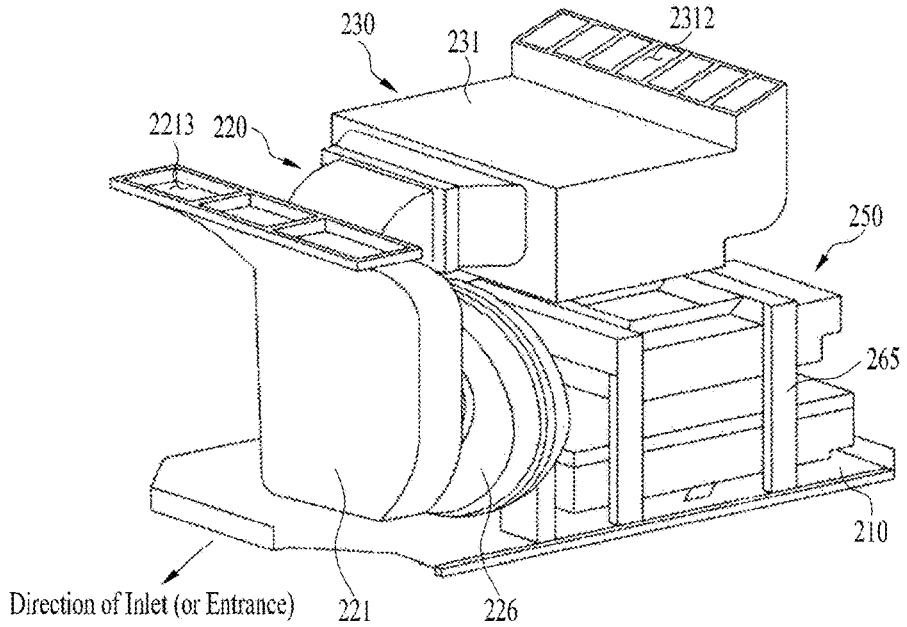

[Fig. 3]
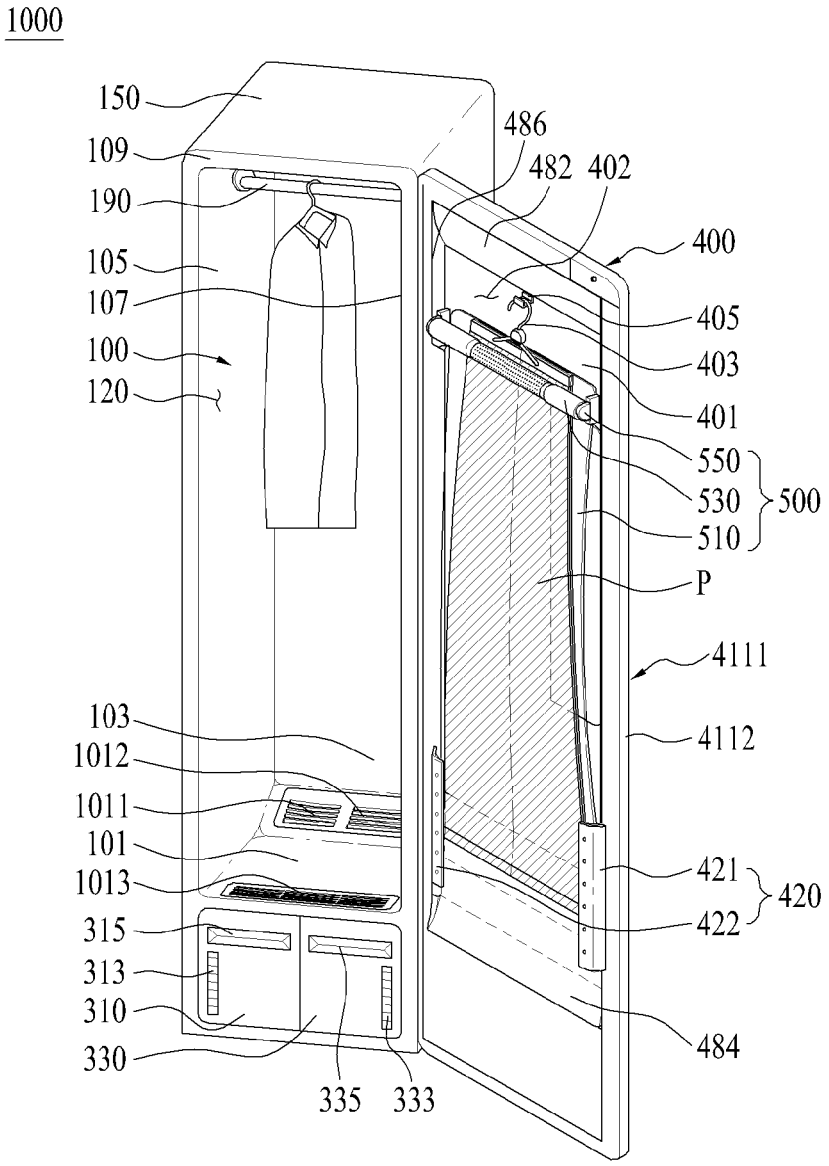

[Fig. 4]
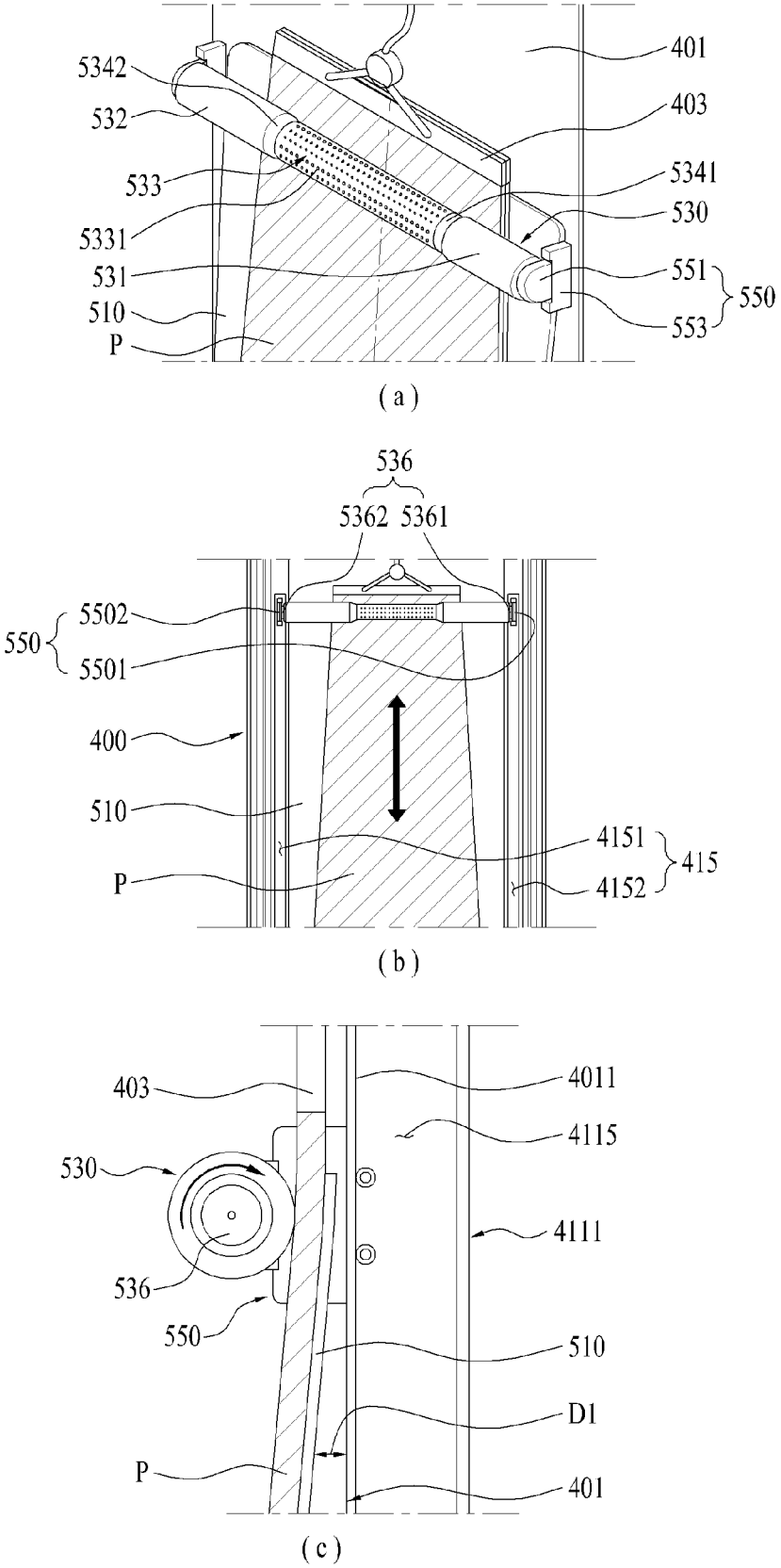

[Fig. 5]
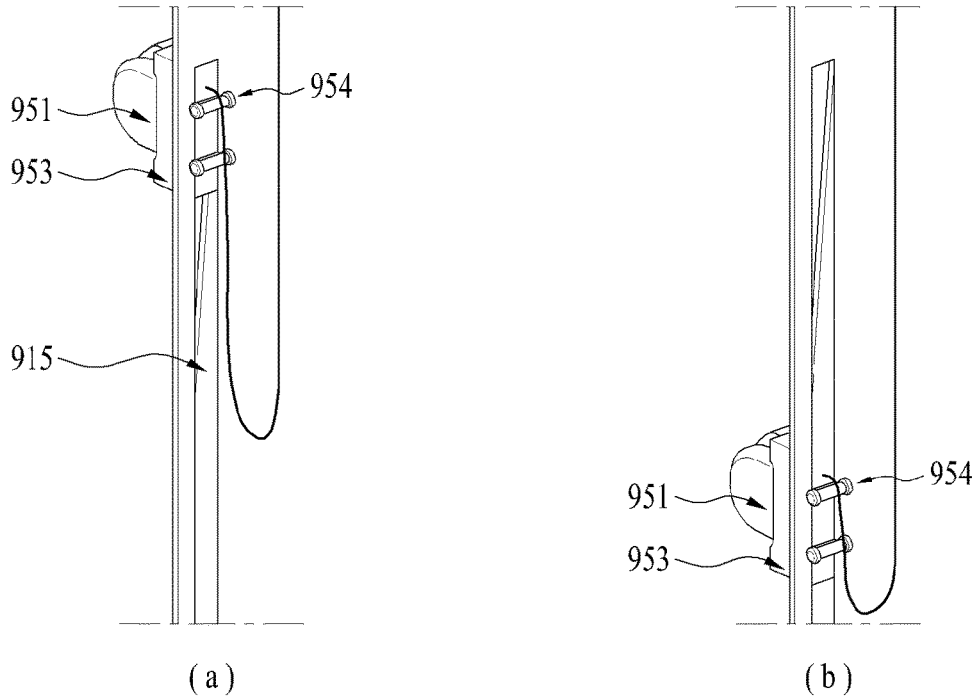
[Fig. 6]
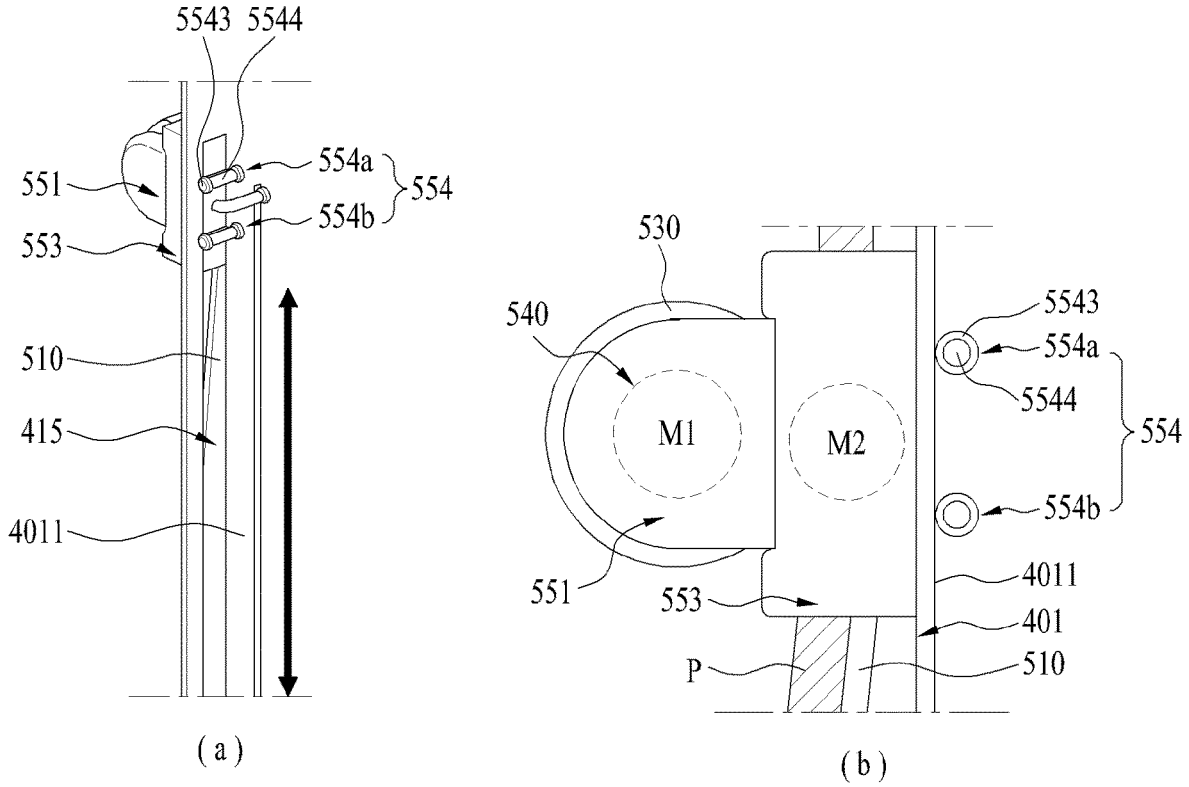

[Fig. 7]
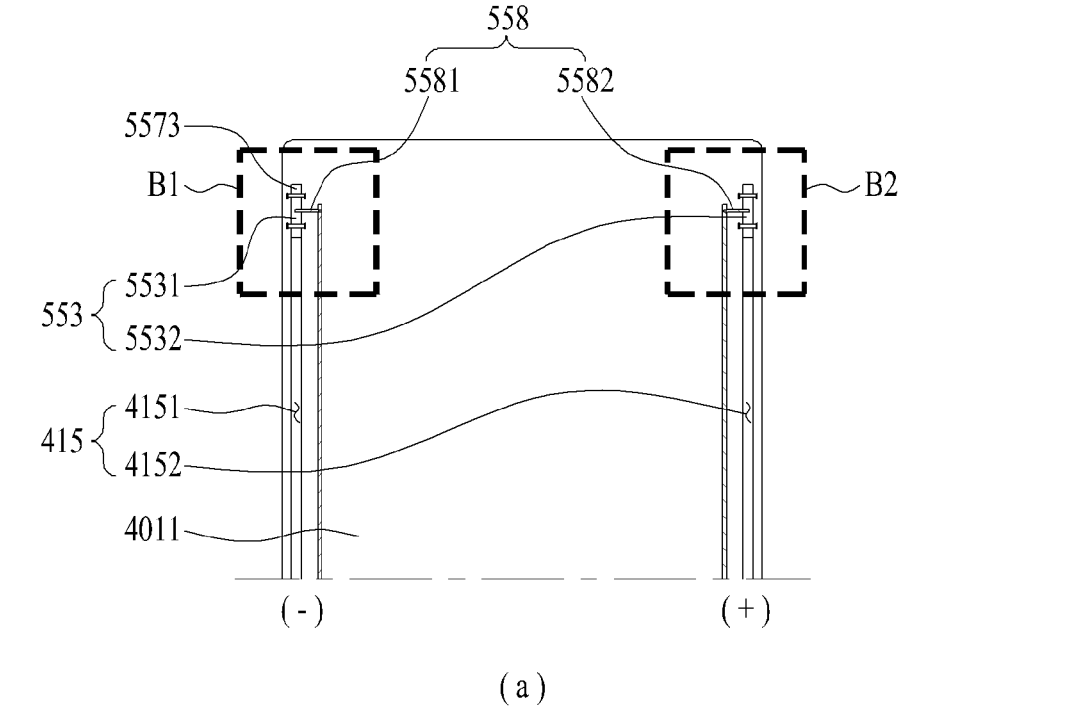
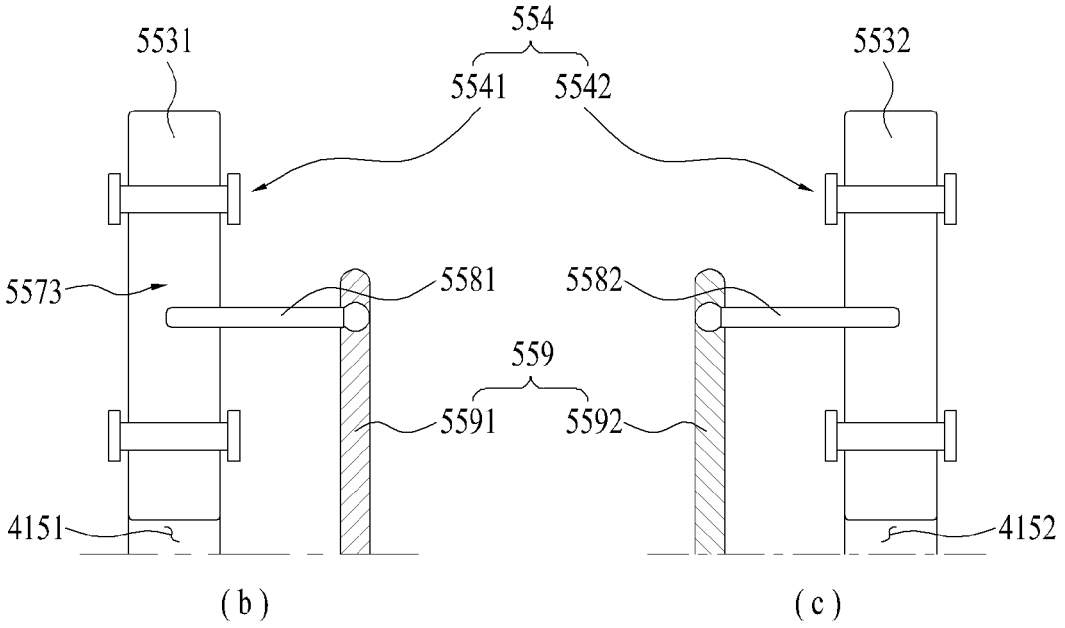

[Fig. 9]
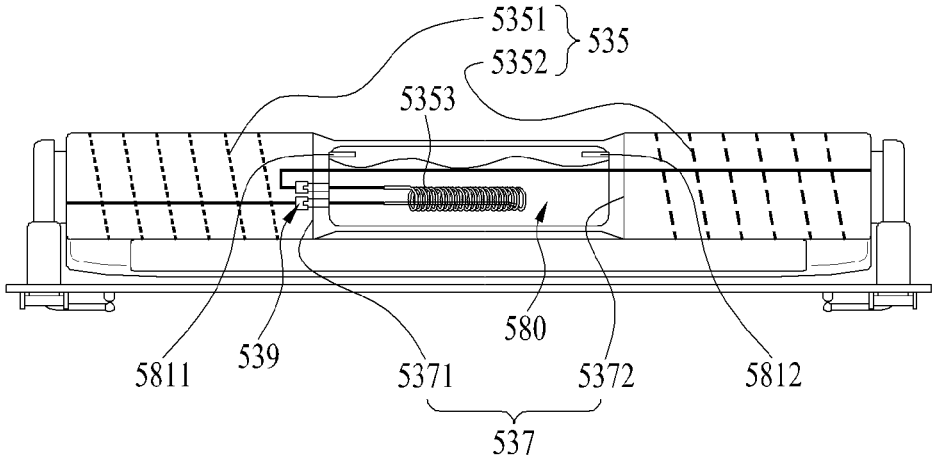
(a)
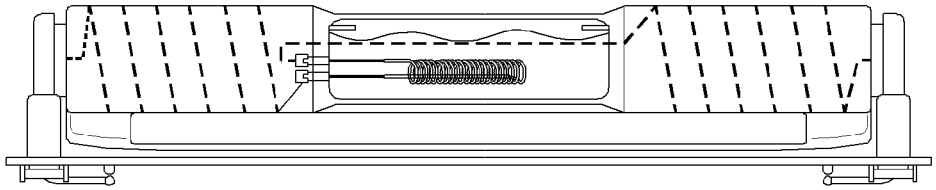
(b)
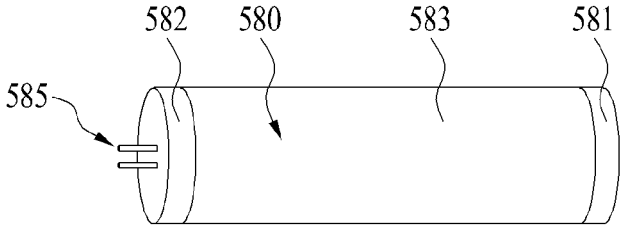
(c)

[Fig. 10]
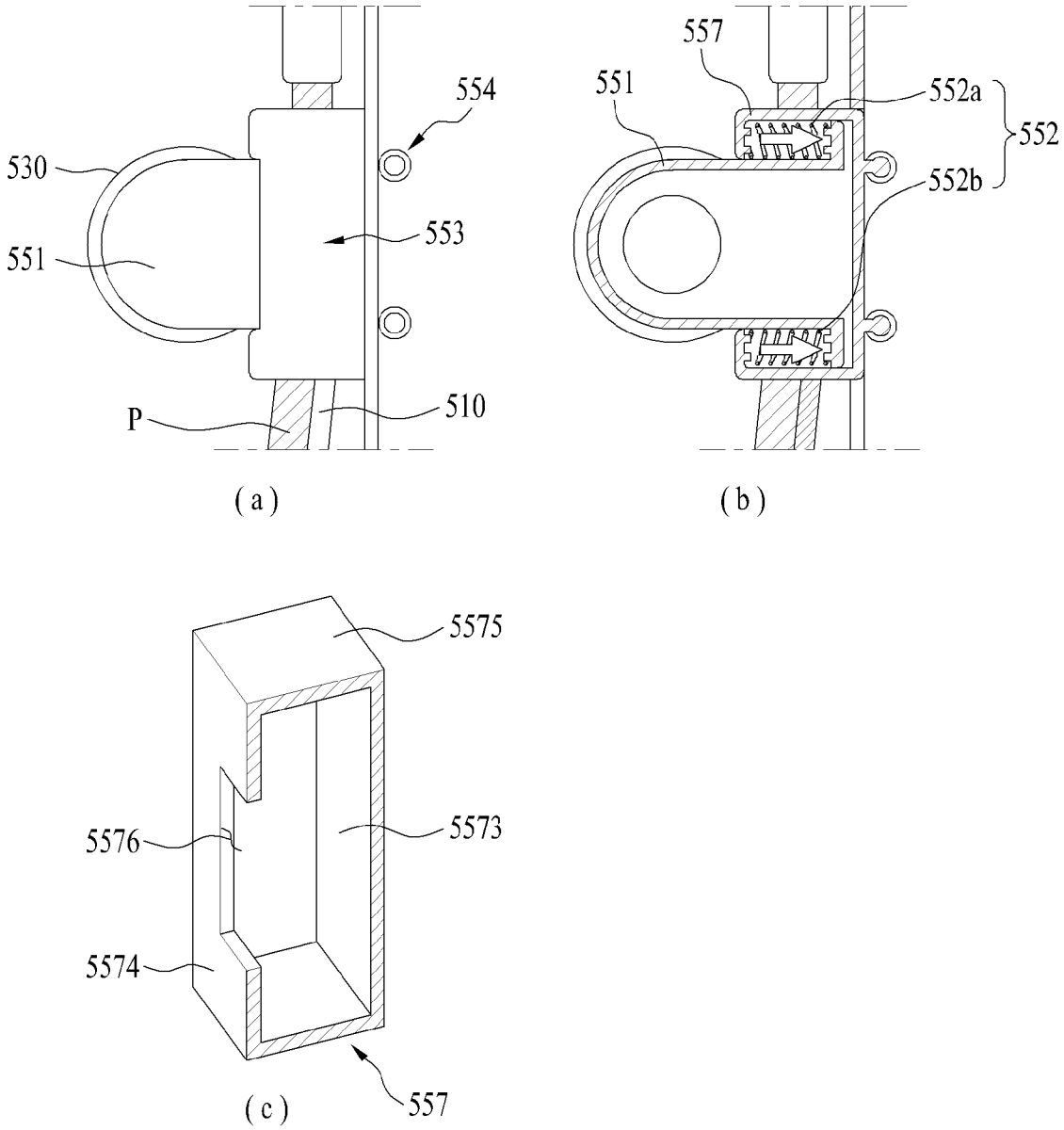

[Fig. 11]
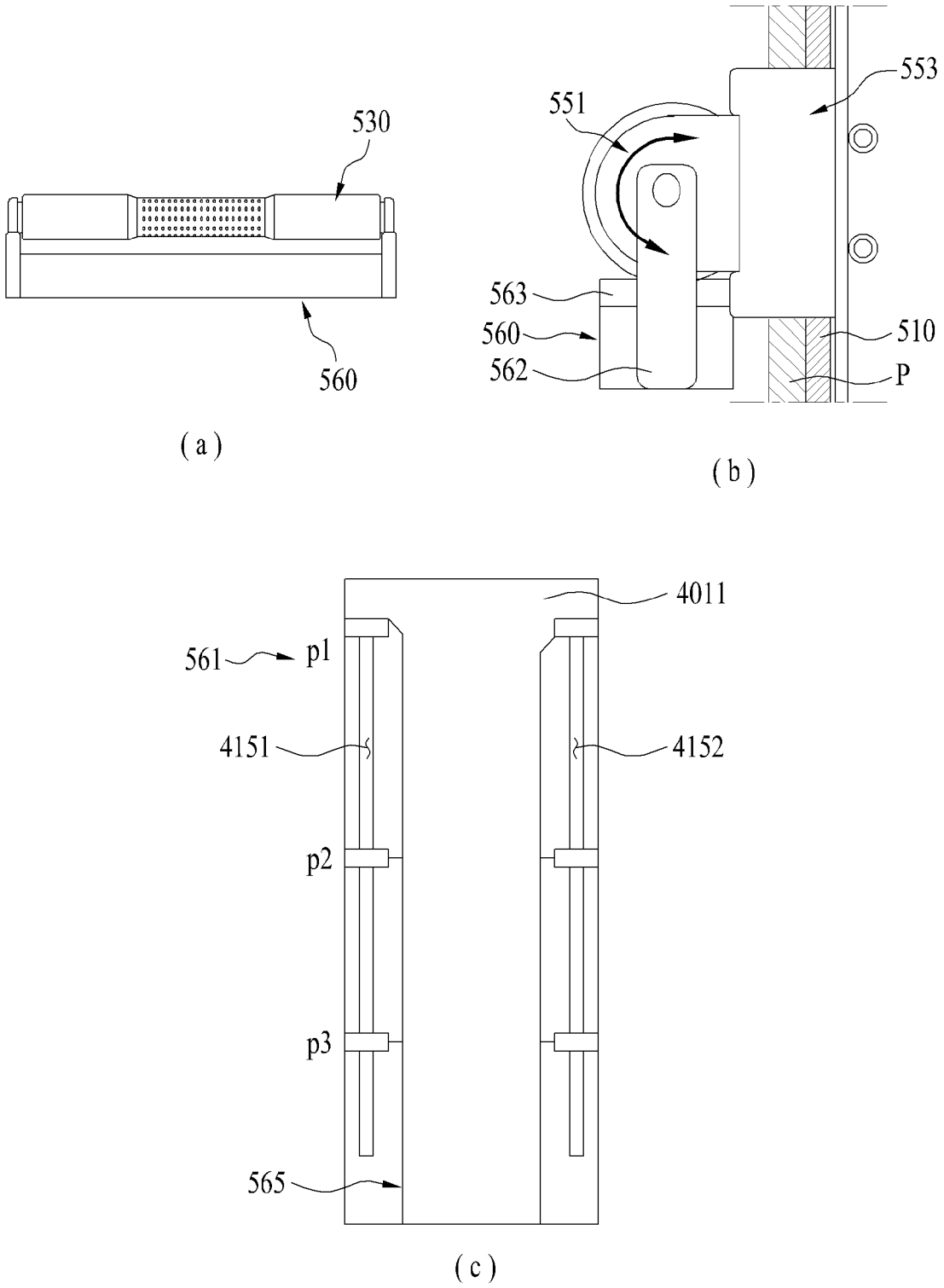

LAUNDRY TREATMENT APPARATUS AND METHOD OF CONTROLLING THE SAME

CROSS-REFERENCE TO RELATED APPLICATIONS

This application is a National Stage application under 35 U.S.C. § 371 of International Application No. PCT/KR2021/020239, filed on Dec. 30, 2021, which claims the benefit of Korean Application No. 10-2020-0189128, filed on Dec. 31, 2020. The disclosures of the prior applications are incorporated by reference in their entirety.

TECHNICAL FIELD

The present disclosure relates to a laundry treatment apparatus and a method of controlling the same, and more particularly to a laundry treatment apparatus and a method of controlling the same, which are configured to press laundry via a roller to thus remove wrinkles from the laundry while exposing the laundry to steam.

BACKGROUND ART

A laundry treatment apparatus refers to an apparatus designed to wash and dry laundry and to remove wrinkles from laundry in a home or a laundromat shop. Those classified into a laundry treatment apparatus may include a washing machine configured to wash laundry, a drying machine configured to dry laundry, a combined washing and drying machine configured to perform both washing and drying, a laundry management machine configured to refresh laundry, and a steamer configured to remove wrinkles from laundry.

A steamer is an apparatus configured to supply steam to laundry in order to remove wrinkles from the laundry. Unlike a typical iron, a steamer is an apparatus configured to remove wrinkles from laundry by applying heat to the laundry via convection without directly applying heat to the laundry (in such a manner as to bring the laundry into contact with a hard object).

Meanwhile, a laundry management machine is an apparatus configured to maintain laundry in a refreshed and clean state. The laundry management machine may be configured to brush dust off of laundry, remove odors from the laundry, dry the laundry, and apply a scent to the laundry. Furthermore, the laundry management machine may serve to prevent the generation of static electricity, remove wrinkles from laundry using dehumidified air or steam, and sterilize the laundry.

Korean Patent Registration Publication No. 10-1220579 discloses a steam supply configured to spray steam. However, because the steam supply serves to supply only steam to laundry without applying tensile force or compressive force to the laundry, there is a limitation on ability to remove wrinkles.

Korean Patent Registration Publication No. 10-2099179 discloses a laundry treatment apparatus. The laundry treatment apparatus is capable of performing deodorization and removal of wrinkles by supplying hot air to a supply part positioned below a cabinet or pressing laundry in the state in which the laundry is disposed in the reception space in the cabinet.

In addition, the laundry treatment apparatus is capable of performing drying, deodorization and removal of wrinkles by supplying hot air or steam to laundry in the state in which the laundry is stretched by its own weight in a cabinet.

Furthermore, the laundry treatment apparatus offers an effect of efficiently removing wrinkles from pants or forming creases in the pants and obviating ironing after completion of washing or drying by pressing the surfaces of the pants using a presser provided on the inner surface of a door.

Particularly, the laundry treatment apparatus is provided on the inner surface of the door with a pants treatment unit (or a press unit), which is also referred to as a presser or a pants press configured to remove unwanted wrinkles or folds and form creases or pleats (intended in the design stage of the pants) in the pants using steam.

The presser is configured to press the pants by rotation on one side surface of the pants. However, because the presser is operated in such a manner as to press the pants beginning from one side surface of the pants, there is no other choice but to sequentially press the pants from the one side surface to the other side surface of the pants. In this case, because higher pressure is applied to the portion of the pants close to the presser and lower pressure is applied to the portion of the pants far away from the presser, there is a problem in which the pants are not uniformly pressed. As a result, there is a problem in that the shape of the pants becomes deformed or the position of the pants is changed due to being pushed by the presser while the pants are pressed by the presser.

Furthermore, the conventional laundry treatment apparatus poses a problem in that a larger number of creases are formed, or creases are formed in a direction completely different from an intended direction.

In addition, because steam and hot air must necessarily be supplied in a treatment chamber, there may be excessive expenditure in that steam and hot air must be supplied throughout the entire treatment chamber in order to remove wrinkles from only one pair of pants. Furthermore, the amount of steam that permeates laundry may be reduced due to a press plate.

Korean Unexamined Patent Publication No. 10-2011-0048343 discloses a scanner, which is configured to apply steam, hot air or heat to pants in the state in which the pants are tightly expanded and fixed to a door inner plate. The scanner is capable of applying steam and/or heat to laundry while moving up and down in the vertical direction of the door in the state in which the laundry is fixed to the door inner plate. However, there is a problem in which the scanner cannot avoid interference with stitch lines, which are positioned at the center of the laundry, because the contact area between the scanner and the laundry is constant. In addition, because there is no space for spraying steam between laundry and the nozzle of the scanner, the steam spraying may be insufficiently performed.

Furthermore, the treatment process in which the scanner slides along the rail as in ironing while the pants are merely pulled by the tensile force exposes limitations on removal of wrinkles or formation of clearly visible pants' leg creases. In addition, because the scanner is not constructed so as to be rotated, the pants may be pushed when the scanner moves up and down.

Furthermore, although it is essential to supply power in order to spray steam and to perform ironing using high temperature heat by supplying power to the scanner which is being moved, the patent document does not disclose the supply of power. When power is supplied merely by connecting an electrical wire to an external power source, the electrical wire may be corroded or deformed due to steam and heat. In addition, there may be problems in which the volume occupied by the electrical wire increases, the electrical wire is entangled, or the electrical wire breaks upon unexpected external impact in severe cases. Moreover, when the electrical wire is simply disposed in the interior space in the door in order to prevent these problems, space may be insufficient to allow the electrical wire to move therein, and thus the electrical wire may become entangled due to unwanted friction, thereby causing a problem in which the electrical wire breaks.

DISCLOSURE OF INVENTION

Technical Problem

One technical task of the present disclosure is to remove wrinkles by efficiently and uniformly pressing laundry in a limited space.

Another technical task of the present disclosure is to spray steam only to laundry from which wrinkles are is to be removed, rather than all of the laundry contained in the chamber, and to heat and press the laundry.

Another technical task of the present disclosure is to minimize double creases by uniformly pressing laundry.

Another technical task of the present disclosure is to press laundry with a constant pressure regardless of the thickness of the laundry.

Another technical task of the present disclosure is to prevent a portion of laundry that does not need to be pressed from being pressed.

Another technical task of the present disclosure is to independently operate only a press unit without operating the entire machine compartment by spraying steam only to laundry from which wrinkles are to be removed.

Another technical task of the present disclosure is to independently operate only a press unit even when a door is open.

Another technical task of the present disclosure is to supply power during upward and downward movement of a roller and to minimize exposure of a power supply to moisture or water.

Another technical task of the present disclosure is to minimize the amount of steam by spraying steam only to the pants to be treated. Furthermore, another technical task of the present disclosure is to minimize energy consumption by heating the pants to be treated.

Another technical task of the present disclosure is to minimize the size of a water supply passage or a steam passage during spray of steam.

Another technical task of the present disclosure is to prevent the generation of wrinkles caused by pressing of stitch lines in laundry by a roller.

Another technical task of the present disclosure is to reduce the volume occupied by a power supply and to prevent the power supply from being exposed to moisture and heat when power is supplied to a press unit which is moving.

Another technical task of the present disclosure is to improve energy efficiency and user convenience by operating only a pants treatment unit.

Solution to Problem

The present disclosure provides a roller-type pants management machine, which is movable in the vertical direction of a door in order to eliminate a phenomenon in which pants are pushed, which occurs in a conventional pants management machine which is operated such that the door is opened and closed rightwards and leftwards. In the pants management machine according to the present disclosure, pants are fixed to a curved base plate (or a rear plate), and a roller is capable of applying pressure to pants while moving from the lower end of the pants to a portion of the pants in which clear creases need to be formed. Furthermore, the roller is capable of uniformly spraying steam to the pants in such a manner as to generate steam while moving upwards and downwards.

Although a conventional pants management machine introduces the concern that an electrical wire is entangled or broken upon supply of power because a roller is moved in a vertical direction, the pants management machine according to the present disclosure is capable of performing wireless supply of power.

In order to achieve the above tasks, the present disclosure provides a laundry treatment apparatus including a cabinet having an entrance formed in one surface thereof, a first chamber, which is positioned in the cabinet and receives laundry therein through the entrance, a second chamber, which is positioned below the first chamber and defines a space isolated from the first chamber, a door having a mount space defined therein and rotatably coupled to the cabinet so as to open and close the entrance, a door inner plate facing the entrance, a laundry hanger support, which is provided on the door inner plate and supports pants hung thereon, a base plate, which is coupled to the door inner plate and supports the pants hung on the laundry hanger support, a guide hole oriented parallel to the base plate in the vertical direction of the door and formed through the door inner plate in a direction perpendicular to the vertical direction and to a width direction of the door, a rotating shaft provided in the width direction of the door so as to be parallel thereto, a roller rotating about the rotating shaft and pressing the pants, a moving unit supporting the rotating shaft and moving in the vertical direction of the door when the roller is rotated, and a power supply, which is accommodated in the mount space and supplies power to the roller.

The power supply may be disposed along the guide hole so as to be parallel thereto, and may be electrically connected to the moving unit so as to supply power to the roller even when the moving unit is moved along the guide hole by rotation of the roller.

The door may include a rear surface, which is the surface of the door inner plate that is positioned far away from the entrance, and a door outer plate coupled to the rear surface so as to define a mount space, the moving unit may include a moving mount, which is inserted partway into the guide hole and moves in the vertical direction of the door, and a moving support, which is coupled to the moving mount and supports the rotating shaft, and the power supply may be electrically connected to the moving mount.

The moving mount may include a moving contact electrically connected to the power supply.

The moving unit may include a wheel, which is provided in the width direction of the door and which is coupled to the side of the moving mount that is inserted into the guide hole so as to prevent the moving unit from being separated from the guide hole and to move the moving unit in the vertical direction of the door.

The moving contact may be coupled to the surface of the moving mount on which the wheel is positioned.

The power supply may include a wire disposed along the guide hole in the vertical direction of the door.

The power supply may include a wire disposed on the rear surface of the door along the guide hole in the vertical direction of the door The wire may be wrapped by a coating member made of an insulation material, in which the coating member is removed in the vertical direction of the door from a portion of the wire that comes into contact with the moving contact.

The rotating shaft may include a first rotating shaft and a second rotating shaft, which are coupled to two ends of the roller, the moving unit may include a first transfer portion and a second transfer portion, which are respectively coupled to the first rotating shaft and the second rotating shaft at the two ends of the roller, and the guide hole may include a first guide hole, into which the first transfer portion is inserted, and a second guide hole into which the second transfer portion is inserted, the first guide hole and the second guide hole being formed in two side surfaces of the base plate in the vertical direction of the door.

The distance between the first guide hole and the second guide hole may be greater than the width of the base plate.

The power supply may include a first wire electrically connected to the first transfer portion, and a second wire electrically connected to the second transfer portion, the first wire and the second wire being respectively disposed along the first guide hole and the second guide hole.

The first transfer portion may include a first contact to be electrically connected to the first wire, and the second may include a second contact to be electrically connected to the second wire.

The power supply may include a battery configured to supply power required to rotate the roller.

The power supply may further include a battery-charging portion configured to charge the battery.

The door comprises a rear surface, which is a surface of the door inner plate that is positioned far away from the entrance, and a door inner plate coupled to the rear surface so as to define a mount space, and the battery-charging portion may be positioned on the rear surface along the guide hole.

The battery-charging portion may include a first charging portion positioned at an upper portion of the guide hole.

The roller may include a first cylindrical press positioned close to one end thereof so as to press the pants, a second cylindrical press positioned close to the other end thereof so as to press the pants, and a cylindrical water supply, which is positioned between the first press and the second press so as to connect same to each other and supplies moisture to the pants.

The moisture supply may have a diameter smaller than a diameter of the first press and the second press.

The roller may include a first heater disposed in the first press so as to heat the first press, and a second heater, disposed in the second press so as to heat the second press.

The power supply may supply power to the roller for rotation of the roller, generation of steam from the moisture supply, and heating of the outer circumferential surface of the roller by the first heater and the second heater.

The roller may be configured such that the diameter of the outer circumferential surface of a region thereof that corresponds to a predetermined length in the direction of the rotating shaft is smaller than the diameter of the two ends of the roller.

Furthermore, in order to achieve the above tasks, the present disclosure provides a method of controlling a laundry treatment apparatus including a cabinet having an entrance formed in one surface thereof, a first chamber positioned in the cabinet and receiving laundry therein through the entrance, a second chamber positioned below the first chamber and defining a space isolated from the first chamber, a door having a mount space defined therein and rotatably coupled to the cabinet so as to open and close the entrance, a door inner plate facing the entrance, a laundry hanger support provided on the door inner plate and supporting pants hung thereon, a base plate coupled to the door inner plate and supporting the pants hung on the laundry hanger support, a guide hole oriented parallel to the base plate in the vertical direction of the door and formed through the door inner plate in a direction perpendicular to the vertical direction and to a width direction of the door, a rotating shaft provided in the width direction of the door so as to be parallel thereto, a roller rotating about the rotating shaft and pressing the pants, and a moving unit supporting the rotating shaft and moving in the vertical direction of the door when the roller is rotated, the method including initiating rotation of the roller at an initial position at which the roller is positioned at the upper end of the guide hole, and returning the roller to the initial position and halting rotation of the roller when a predetermined period of time has elapsed since the initiation of rotation of the roller.

The method may further include measuring a first charge amount of the battery, which is configured to supply power to the roller at a first charging portion disposed at the initial position before initiation of rotation of the roller, and which charges the battery via the first charging portion when the first charge amount is smaller than a predetermined first reference charge amount.

The method may further include measuring a second charge amount of the battery when the roller reaches a second charging portion disposed along the guide hole after initiation of rotation of the roller, and charging the battery via a second charging portion which the roller reaches when the second charge amount of the battery is smaller than a predetermined second reference charge amount.

Advantageous Effects of Invention

The present disclosure is capable of removing wrinkles by efficiently and uniformly pressing laundry in a limited space.

The present disclosure is capable of spraying steam only to laundry from which wrinkles are to be removed, rather than the entire chamber receiving laundry, and heating and pressing the laundry.

The present disclosure is capable of minimizing double creases by uniformly pressing laundry.

The present disclosure is capable of pressing laundry with a constant pressure regardless of the thickness of the laundry.

The present disclosure is capable of preventing a portion of laundry that does not need to be pressed, from being pressed.

The present disclosure is capable of independently operating only a press unit without operating the entire machine compartment by spraying steam only to laundry from which wrinkles are to be removed.

The present disclosure is capable of independently operating only a press unit even when a door is open.

The present disclosure is capable of supplying power during upward and downward movement of a roller and of minimizing exposure of a power supply to moisture or water.

The present disclosure is capable of minimizing the amount of steam that is used by spraying steam only to the pants to be treated. Furthermore, the present disclosure is capable of minimizing energy consumption by heating the pants to be treated.

The present disclosure is capable of minimizing a water supply passage or a steam passage during spray of steam.

The present disclosure is capable of preventing the generation of wrinkles caused by pressing of stitch lines in laundry by a roller.

The present disclosure is capable of reducing the volume occupied by a power supply and preventing the power supply from being exposed to moisture and heat when power is supplied to a press unit which is moving.

The present disclosure is capable of improving energy efficiency and user convenience by enabling only a pants treatment unit to be operated.

BRIEF DESCRIPTION OF DRAWINGS

FIG. 1 illustrates an embodiment of a conventional laundry treatment apparatus;

FIG. 2 illustrates an embodiment of a mechanical component included in a second chamber;

FIG. 3 illustrates a laundry treatment apparatus including an embodiment of a press unit, which is a feature of the present disclosure;

FIG. 4(*a*) is an enlarged view illustrating an embodiment of the press unit, FIG. 4(*b*) illustrates the embodiment of the press unit, which is coupled to a door inner plate so as to press pants, and FIG. 4(*c*) is a view of the press unit when viewed from a lateral side;

FIG. 5(*a*) illustrates a moving unit positioned at the upper end of a guide hole in the state in which the moving unit is connected to an electrical wire, and FIG. 5(*b*) illustrates the moving unit positioned at an intermediate level of the guide hole in the state in which the moving unit is connected to the electrical wire;

FIG. 6(*a*) illustrates a moving unit inserted into a guide hole formed through the door inner plate, and FIG. 6(*b*) illustrates the moving unit inserted into the guide hole when viewed from a lateral side;

FIG. 7(*a*) illustrates the guide hole and a power connection structure when viewed from the rear surface of the door inner plate, and FIGS. 7(*b*) and 7(*c*) illustrate moving mounts and wheels, which are provided at two lateral sides, when viewed from the rear surface;

FIG. 9(*a*) illustrates embodiments of a first heater, a second heater, and a steam heater, which are provided in the roller, FIG. 9(*b*) illustrates other embodiments of the first heater, the second heater, and the steam heater, which are provided in the roller, and FIG. 9(*c*) illustrates an embodiment of a steam generation tank provided in the roller;

FIG. 10(*a*) illustrates the state in which pants disposed on a base plate are pressed by the roller when viewed from a lateral side, FIG. 10(*b*) illustrates a cross section of the moving unit, and FIG. 10(*c*) illustrates a cross section of a moving mount;

FIG. 11(*a*) illustrates an embodiment in which a battery for wireless operation of the roller is mounted, FIG. 11(*b*) illustrates the roller when viewed from a lateral side, and FIG. 11(*c*) illustrates a plurality of charging points provided on the rear surface.

MODE FOR THE INVENTION

Figure 8:
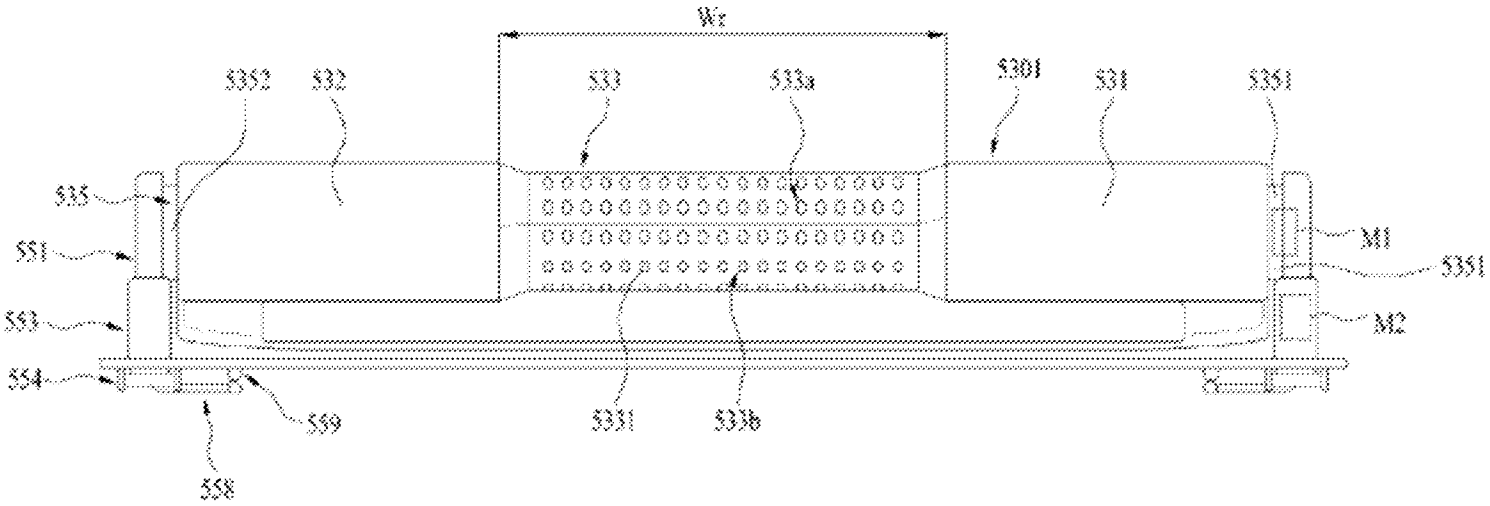
FIG. 8 illustrates the press unit.

Reference will now be made in detail to the preferred embodiments of the present invention, examples of which are illustrated in the accompanying drawings. It should be noted herein that construction of an apparatus, which will hereinafter be described, and a method of controlling the apparatus are given only for illustrative purposes and the protection scope of the present disclosure is not limited thereto. Wherever possible, the same reference numbers will be used throughout the drawings to refer to the same or like parts.

The specific terminology used in this specification is only for convenience of explanation, and is not intended to limit the disclosed embodiment.

For example, the term "same" or "identical" not only represents exactly the same state but also represents a state in which there is a tolerance, or a difference that those not prevent the same function from being realized.

For example, an expression indicating a relative or absolute position such as "in a certain direction", "along a certain object", "in parallel", "perpendicularly", "about", "concentric", and "coaxial", may not only represent the exact position but may also represents a state of relative displacement with a tolerance, or an angle or a distance that does not prevent the same function from being realized.

In this specification, the term "wrinkle" means a wrinkle (or a crinkle) or a fold which is unintentionally formed after wearing of clothes or after washing or drying of laundry. In other words, the term "wrinkle" means a wrinkle or crinkle which is unintentionally formed in clothes in use or in laundry during washing or drying rather than a pleat or a crease which is intentionally provided for the purpose of design or function at design stage. Accordingly, unless the context expressly indicates an intended pleat or crease, the term "wrinkle" means a wrinkle (or a crinkle) or a fold which is unintentionally formed in clothes in use or in laundry after washing or drying.

FIG. 1 illustrates an example of a conventional laundry treatment apparatus 2000. The laundry treatment apparatus 2000 includes a cabinet 150 having an entrance 120 formed in one side thereof, a first chamber 100, which is defined in the cabinet 150 so as to receive laundry through the entrance 120, a second chamber 200, which is positioned below the first chamber 100 so as to define a space isolated from the first chamber 100, a steam unit 250 (see FIG. 2), which is disposed in the second chamber 200 and which creates steam and supplies the steam the first chamber 100, and a door 400, which is rotatably coupled to the cabinet 150 so as to open and close the entrance 120. Considering general usage by a user, the entrance 120 is preferably provided at the front side of the cabinet 150.

The laundry treatment apparatus 2000 may further include a blower unit 220 (see FIG. 2), which is disposed in the second chamber 200 and sucks air in the first chamber 100, and a heat pump unit 230, configured to dehumidify and heat the sucked air and to discharge the dehumidified air into the first chamber 100.

The cabinet 150 may be formed of a metal material but may also be made of a plastic material, as long as the cabinet is capable of maintaining a required strength. The first chamber 100 may be formed through plastic injection molding. Although the first chamber 100 may be coupled to the cabinet 150 by means of a frame (not shown), the space between the cabinet 150 and the first chamber 100 or the space between the cabinet 150 and the second chamber 200 may be filled with foamed plastic such as polyurethane.

A laundry including tops and bottoms may be disposed in the first chamber 100, and may be managed in the refreshed state by means of the blower unit 220 (see FIG. 2) disposed in the second chamber 200, the heat pump unit 230 (see FIG. 2), and the steam unit 250 (see FIG. 2). In other words, it is possible to perform functions of sterilizing and deodorizing the laundry and of removing wrinkles formed in the laundry during use, using steam and/or heated air, which is created by the blower unit 250 (see FIG. 2), the heat pump unit 230 (see FIG. 2), and the steam unit 250 (see FIG. 2), which are positioned in the second chamber 200.

The first chamber 100 may include a laundry support 190 configured to support the laundry at an upper level inside the first chamber 100. The laundry support 190 may include a hanger on which the laundry is hung, and may be connected to a drive unit (not shown) capable of reciprocating the laundry support 190 to the right and left. The movement of the laundry support 190 may shake the laundry, thereby removing contaminants including fine dust from the laundry. Furthermore, it is possible to remove wrinkles from the laundry to a certain extent by exposing the laundry to steam or moisture supplied from the second chamber 200 while the laundry supported by the laundry support 190 is shaken.

In other words, the laundry support 190 may support the laundry, which is disposed in the first chamber 100 in the state of being expanded due to its own weight such that the laundry is uniformly exposed to the dehumidified and heated air and/or steam which is supplied from the second chamber 200.

Generally, water boils at a temperature of 100° C. under atmospheric pressure, and the created water vapor may be referred to herein as steam. Meanwhile, "moisture" may refer to fine water droplets each having a size of 10 mm or less, which are suspended in air at an ambient temperature, like fog. Generally, steam, which is created by boiling water, has bactericidal power superior to moisture because the temperature thereof is higher than that of moisture, and has excellent ability to permeate laundry because water molecules move more actively at high temperatures. Accordingly, steam may be more efficiently used to refresh laundry than moisture.

The first chamber 100 is defined by a first chamber upper surface 109, on which the drive unit (not shown) of the laundry support 190 is positioned, a first chamber bottom surface 101 defining the bottom surface thereof, first chamber right and left lateral surfaces 105 and 107 connecting the first chamber upper surface 109 to the first chamber bottom surface 101, and a first chamber rear surface 103. When the surface in which the entrance 120 is formed is the front surface, the first chamber rear surface 103 will be positioned on the opposite side.

The first chamber bottom surface 101 may be provided therein with an air supply port 1011 and a steam supply port 1012, through which the air, which is dehumidified and heated by the heat pump unit 230, and the steam, which is created by the steam unit 250, in the second chamber 200 are supplied to the first chamber 100, and an air intake port 1013, through which the air in the first chamber 100 is sucked by means of the blower unit 220.

As illustrated in FIG. 1, the air supply port 1011 and the steam supply port 1012 may be provided in the region at which the first chamber bottom surface 101 meets the first chamber rear surface 103. Here, the region at which the first chamber bottom surface 101 meets the first chamber rear surface 103 may be smoothly inclined. The air intake port 1013 may be positioned on the first chamber bottom surface 101 close to the entrance 120. Consequently, the air in the first chamber 100 is discharged through the air supply port 1011, and is sucked into the first chamber 100 through the air intake port 1013, thereby forming a circulating flow. Meanwhile, the steam in the first chamber 100 is also discharged through the steam supply port 1012 and condensed, and the condensed steam is sucked into the first chamber 100 through the air intake port 1013 and collected in a sump (not shown) for storing the condensed water therein.

In order to more efficiently guide the condensed water in the first chamber 100 toward the second chamber 200 through the air intake port 1013, the first chamber bottom surface 101 may be inclined downwards towards the entrance 120 from the first chamber rear surface 103.

As illustrated in FIG. 1, the laundry treatment apparatus 2000 may include a water supply tank 310, configured to supply water to the steam unit 250, and a water discharge tank 330, configured to store therein the condensed water discharged from the sump (not shown), both of which are provided at the front side of the second chamber 200. Furthermore, a tank module frame (not shown) configured to define a tank-mounting space (not shown), in which the water supply tank 310 and the water discharge tank 330 are mounted, may be provided in order to isolate the tank-mounting space (not shown) from the second chamber 200. In other words, the tank-mounting space 351 and the second chamber 200 are positioned below the first chamber 100, the tank-mounting space may be positioned close to the door 400, and the second chamber 200 may be positioned behind the tank-mounting space.

The water supply tank 310 and the water discharge tank 330 may be respectively and detachably coupled to the tank module frame (not shown). Alternatively, the water supply tank 310 may be integrally coupled to the water discharge tank 330, and may thus be detachably coupled to the tank module frame together with the water discharge tank 330.

The door 400 may include a door inner plate 401, which is positioned on the rear surface of the door 400 or on the surface of the door 400 that faces the first chamber 100 when the door 400 is closed. The door 400 may be hingedly and rotatably connected to the cabinet 150 so as to open and close the entrance 120.

The front surface of the water supply tank 310 and the front surface of the water discharge tank 330 may face the door inner plate 401 when the door 400 is closed by a user, and may be exposed to the outside when the door 400 is opened by the user. Because the water supply tank 310 has a water supply tank window 313 formed in the front surface thereof and the water discharge tank 330 has a water discharge tank window 333 formed in the front surface thereof, it is possible to check the levels of the water stored in the water supply tank 310 and the water discharge tank 330.

The front surface of the water supply tank 310 may be provided with a water supply tank handle 315, and the front surface of the water discharge tank 330 may be provided with a water discharge tank handle 335. When a user pulls the water supply tank handle 315 or the water discharge tank handle 335, the water supply tank 310 or the water discharge tank 330 may be rotated about an end of the front surface thereof, and may be separated from the tank module frame (not shown). When the water supply tank 310 or the water discharge tank 330 is mounted in the tank module frame (not shown), the water supply tank 310 or the water discharge tank 330 may be mounted in the tank module frame (not shown) while being rotated.

In the conventional laundry treatment apparatus 2000, the door inner plate 401 or the inside of the first chamber 100 may be provided with a laundry hanger support 405, on which a laundry hanger 403 including inverted pants P hung thereon is hung, and a presser 50 configured to press the pants P, which are held by the laundry hanger support 405 and the laundry hanger 403.

The reason why the pants P are hung in the state in which the bottom hems of the pants P are positioned upwards is to uniformly spread the pants P using the tensile force resulting from the weight of the pants P because the weight of the pant waist portion of the pants P is heavier than the pant leg part of the pants P.

The presser 50 may include a support plate 51, which is coupled to the door inner plate 401 so as to support the laundry, and a rotating plate 52, which is rotatable toward the support plate 51 so as to press the pants P. When the rotating plate 52 is rotated toward the support plate 51 and is coupled thereto, it is possible to press the pants P. Thereafter, when the door 400 is closed, the pants P are steamed and dehumidified and are exposed to heated air, thereby removing wrinkles. Here, the rotating plate 52 may have a rotating plate through hole 54 formed therethrough in order to allow steam to easily permeate the pants P, and may further have a depressed portion 55, which is formed in the surface of the rotating plate 52 that comes into contact with the pants P, in order to prevent the seams of pants P, which are provided in the longitudinal direction of the leg parts of the pants P, from being pressed.

Referring to FIG. 2, the second chamber 200 may be provided therein with the blower unit 220, configured to suck air in the first chamber 100, the steam unit 250 configured to receive water from the water supply tank 310 to thus generate steam and to supply the steam to the first chamber 100, and the heat pump unit 230, configured to dehumidify and heat the air that is sucked by the blower unit 220 and to discharge the air into the first chamber 100. Furthermore, the second chamber 200 may be provided therein with a controller (not shown) configured to control the blower unit 220, the steam unit 250, and the heat pump unit 230.

The steam unit 220 may be provided in order to sterilize and deodorize the laundry disposed in the first chamber 100 and to remove wrinkles from the laundry, and the blower unit 220 and the heat pump unit 230 may be provided in order to circulate the air in the first chamber 100 and to dehumidify the air through heat exchange.

In addition, the controller may control a press unit 500, which will be described later. The controller may control the rotation of rollers 530, 570 and 670, which will be described later. Furthermore, the controller may control the reciprocating movement of the laundry support 190 (see FIG. 1).

In order to supply the dehumidified and heated air to the first chamber 100, the air in the first chamber 100 is sucked through an inlet duct 221 using suction force generated by a blower fan 226. Subsequently, the air is transmitted to the heat pump unit 230 and heat-exchanged therein, and is again supplied to the first chamber 100.

Referring to FIG. 2, the blower unit 220 may include the blower fan 226 and the inlet duct 221. Assuming that the direction in which the entrance 120 is positioned is referred to as a forward direction and the direction in which the rear surface of the first chamber 100 is positioned is referred to as the backward direction, the inlet duct 221 may be provided in front of the blower fan 226, and the tank module frame (not shown) may be provided in front of the inlet duct 221. Accordingly, the tank module frame may isolate the tank-mounting space 351 from the second chamber 200.

The water supply tank 310 and the water discharge tank 330, which are mounted on the tank module frame (not shown), may be positioned close to one lateral side surface of the cabinet 150, among the two lateral side surfaces of the cabinet 150. For example, the water supply tank 310 may be positioned in the tank-mounting space (not shown) closer to the right lateral side surface than to the left lateral side surface of the cabinet 150, whereas the water discharge tank 330 may be positioned in the tank-mounting space (not shown) closer to the left lateral side surface than to the right lateral side surface of the cabinet 150.

Like the water supply tank 310, the steam unit 250 may also be positioned in the second chamber 200 closer to the right lateral side surface than to the left lateral side surface of the cabinet 150. The reason for this is to simplify the connecting passage between the water supply tank 310 and the steam unit 250, along which water flows, by positioning the steam unit 250 behind the water supply tank 310.

The steam unit 250 may heat the water disposed in the steam unit 250 to generate steam using a heater, and the generated steam may flow along a steam passage (not shown) to the steam supply port 1012, which is provided on the bottom surface 101 of the first chamber 100.

If the water supply tan 310 is positioned closer to the left lateral side surface than to the right lateral side surface of the cabinet 150, the steam unit 250 may also be positioned closer to the left lateral side surface than to the right lateral side surface of the cabinet 150.

The inlet duct 221 may include an inlet duct inlet 2213, which communicates with the air intake port 1013 formed in the bottom surface 101 of the first chamber 100 and through which the air in the first chamber 100 is sucked. The inlet duct inlet 2213 may define a sloped passage. The reason for this is to enable the condensed water formed in the first chamber 100 and on the door 400 to easily flow to the sump (not shown) provided in the lower portion of the inlet duct 221 through the inlet duct inlet 2213 and along the sloped passage.

The inlet duct 221 may be positioned in front of the blower fan 226, and the steam unit 250 and the heat pump unit 230 may be positioned behind the blower fan 226. The heat pump unit 230 may be supported by a supporter 265. The supporter 265 may be provided on a base 210, which defines the bottom of the second chamber 200. Accordingly, the supporter 265 may provide a predetermined distance between the base 210 and the heat pump unit 230, and a predetermined mounting space may be defined between the support 265 and the base 210. The steam unit 250 may be positioned in the mounting space, and may be coupled to the supporter 265 in the mounting space. Although FIG. 2 illustrates an embodiment in which the controller 270 is positioned bellow the steam unit 250 in the mounting space defined by the supporter 265, the controller 270 may positioned at any location, such as behind the steam unit 250 or in the second chamber 200.

The heat pump unit 230 may include a housing 231, which accommodates therein a first heat exchanger (or an evaporator, not shown) and a second heat exchanger (or a condenser, not shown), and an air discharge outlet 2312, which communicates with the air supply port 1011 provided in the first chamber 100 in order to discharge the dehumidified and heated air to the first chamber 100 from the housing 231. A compressor (not shown) and an expansion valve, which are configured to circulate refrigerant, may be positioned outside the supporter 265.

Unlike those shown in FIG. 2, the blower unit 220 may circulate the air in the first chamber 100, and the evaporator and the condenser may be provided in the duct, through which the air, circulated by the blower unit 220, flows. In other words, the blower unit may composed of the inlet duct 221, the blower fan 226, a connecting duct (corresponding to the housing shown in FIG. 2), and an exhaust duct (corresponding to the air discharge outlet shown in FIG. 2), and the heat pump unit may include the evaporator and the condenser, which are provided in the connecting duct, and the compressor and the expansion unit, which are provided outside the blower unit 220.

Referring to FIG. 3, the door 400 may include the door inner plate 401, which is the surface of the door 400 that faces the first chamber 100, a door gasket 486, which is provided on the door inner plate 401 in the state of being in tight contact with the peripheral portion of the cabinet 150 so as to form sealing between the door 400 and the cabinet 150, and door liners 482 and 484, which are provided on the door inner plate 401 so as to guide the condensed water created in the first chamber 100 toward the first chamber bottom surface 101. In some embodiments, the door 400 may be configured to simultaneously open and close the first chamber 100 and the tank-mounting space 352. In another embodiment, a plurality of doors may be mounted on the cabinet 150 so as to respectively open and close the first chamber 100 and the tank-mounting space 351. The door liners 482 and 484 may be configured to face the first chamber 100 when the door 400 is closed, and may include an upper door liner 482 and a lower door liner 484. The door liners 482 and 484 may discharge the condensed water, which is generated on the surfaces of the door liners 482 and 484, to the sump (not shown), provided below the inlet duct, through the air intake port 1013 formed in the bottom surface 101 of the first chamber.

The door gasket 486 may be mounted on the door inner plate 401 so as to surround the door inner plate 401. The seal between the door 400 and the cabinet 150 may be established by the door gasket 486. The door gasket 486 may seal the first chamber 100 and the tank-mounting space (not shown), in which the water supply tank 310 and the water discharge tank 330 are mounted, from each other.

Referring to the example of the presser 50 shown in FIG. 1, the rotating plate 52 may be rotated toward the support plate 51 on which the pants P are disposed. The rotating plate 52 may be rotated to press the pants P about a rotational coupler (not shown), for example, a hinge, which is provided on one surface of the rotating plate 52. A region of the rotating plate 52 close to the rotational coupler may continue to press the pants P until the rotating plate 52 is completely rotated to face the support plate 51, that is, until the other surface of the rotating plate 52 is coupled to the support plate 51.

Accordingly, uniform pressure is not applied to the pants P while the rotating plate 52 is rotated. At this point, because higher pressure is applied to a region of the pants P close to the rotational coupler whereas lower pressure is applied to a region of the pants P far from the rotational coupler, there is a problem in which the pants P are not uniformly pressed.

Furthermore, there may be a problem in which the held shape of the pants P is deformed or the pants P are displaced in position because the pants P are pushed by the rotating plate 52 while the pants P are pressed by the rotating plate 52. Therefore, the conventional laundry treatment apparatus 2000 may have a problem in which more wrinkles are generated or creases are formed in a direction other than the intended direction.

Furthermore, because the pants P are simply hung on the laundry hanger support 405 (see FIG. 1) rather than being held, there is a problem whereby it is impossible to prevent the position of the pants P from changing during pressing.

When the pants P are suspended in the state of being spread across the length of the door inner plate rather than being folded, a user may suffer inconvenience because the laundry hanger support 405 (see FIG. 1) is high. In addition, because the pants P occupies almost the entire area of the door inner plate 401, there is a problem whereby the availability of the door inner surface 401 is deteriorated.

In order to press the pants P using the presser 50, remove wrinkles, and efficiently form intended creases, the steam unit 250, the blower unit 220, and the heat pump unit 230, which are provided in the second chamber 200, must be activated. The reason for this is because a dedicated steam generator for the presser 50 is not provided with an air heater. This means that the entire laundry treatment apparatus 2000 must be necessarily operated in order to press the pants P using the presser 50. Furthermore, when the laundry disposed in the first chamber 100 is completely refreshed before using the presser 50, there is inconvenience in which the presser 50 must be used after taking the refreshed laundry out of the first chamber 100.

In addition, the rotational direction of the rotating plate 52 must be changed depending on whether a user is right-handed or left-handed. Accordingly, there is inconvenience in that the rotating plate 52 may need to be separated and reassembled when the user changes.

FIG. 3 illustrates a laundry treatment apparatus 1000 according to an embodiment of the present disclosure in which an embodiment of a press unit 500, which is different from the presser 50 of the conventional laundry treatment apparatus configured to remove wrinkles in the pants P, is illustrated. The feature of the present disclosure is to propose a novel press unit that overcomes the above-mentioned problems.

Specifically, the laundry treatment apparatus 1000 according to the present disclosure includes the cabinet 150 having the entrance 120 formed in one surface thereof, the first chamber 100, which is positioned in the cabinet 150 and receives therein laundry through the entrance 120, the second chamber 200, which is positioned below the first chamber 100 and is isolated from the first chamber 100, the door 400, which is rotatably coupled to the cabinet 150 so as to open and close the entrance 120, the door inner plate 401, which is the surface of the door 400 that faces the first chamber 100, the laundry hanger support 405, which is provided on the door inner plate 401 and on which the pants P are hung, and a roller-type press unit 500, which is coupled to the door inner plate 401 so as to hold and press the laundry.

The press unit 500 may include a base plate 510, configured to support the pants P hung on the laundry hanger support 405, a rotating shaft 536, provided in the width direction of the door 400, a roller 530, which is rotated about the rotating shaft 536 and presses the pants P, and a moving unit 550, which supports the rotating shaft 536 and moves the rotating shaft 536 and the roller 530 in the height direction of the door 400.

Furthermore, the laundry treatment apparatus 1000 may include a drive unit 540 (see FIG. 5), which is provided at the roller 530 and the moving unit 550 so as to rotate the roller 530.

Rather than simply pressing laundry while being passively rotated by movement of the moving unit 550, as in the conventional laundry treatment apparatus, the roller 530 not only elastically presses the laundry while being actively rotated by the drive unit 540 but also presses the laundry using the rotative force of the drive unit 540. In other words, the roller 530 may be rotated while pressing the laundry disposed on the base plate 510.

When the roller 530 is actively rotated while pressing the laundry, the moving unit 550 may be passively moved by the rotation of the roller 530. In other words, by means of the drive unit configured to rotate the roller 530, the rotation of the roller 530 and the movement of the moving unit 550 may be performed simultaneously.

The roller 530 may be shaped such that, based on the width direction of the door, the middle portion of the roller 530 may have a diameter less than that of the two end portions of the roller 530. The reason for this is to avoid a stitch line portion of pants, which is thicker than the fabric of the leg part of pants and to provide a space into which steam is sprayed such that the steam uniformly permeates the fabric of the pants P. Furthermore, the reason for this is to prevent the steam from being sprayed only in a direction opposite the direction in which steam is sprayed toward laundry through the roller 530 because the pressure in steam spray holes 5331 formed in the side of the roller 530 that face the laundry is higher than the pressure in steam spray holes 5331 formed in the opposite side of the roller 530.

In other words, the roller 530 may be configured to have a shape similar to that of a dumbbell. Specifically, the outer circumferential surface of a region of the roller 530, which corresponds to a predetermined length in the longitudinal direction of the rotating shaft 536 or in the width direction of the door 400, may have a diameter less than that of the two ends of the roller 530. The reason for this is to provide a space that avoids stitch lines that are positioned at the center line of suspended pants and into which steam is sprayed.

Referring to FIG. 2, the second chamber 200 may be provided therein with the blower unit 220 configured to suck air in the first chamber 100, the steam unit 250 configured to receive water to thus generate steam and to supply the steam to the first chamber 100, and the heat pump unit 230 configured to dehumidify and heat the air sucked by the blower unit 220 and to discharge the air to the first chamber 100. Furthermore, the second chamber 200 may be provided therein with the controller (not shown) configured to control the blower unit 220, the steam unit 250, and the heat pump unit 230.

The steam unit 220 may be provided so as to sterilize and deodorize the laundry disposed in the first chamber 100 and to remove wrinkles from the laundry, and the blower unit 220 and the heat pump unit 230 may be provided so as to circulate the air in the first chamber 100 and dehumidify the air through heat exchange.

The steam unit 250 may be used to refresh the laundry disposed in the first chamber 100. The press unit 500 shown in FIG. 3 may include a steam generation tank 580 (see FIG. 8), which is operated independently of the steam unit 250. Furthermore, the press unit 500 may include a heater 535 (see FIG. 8) configured to heat the pants P, in place of the blower unit 220 and the heat pump unit 230. Accordingly, it is possible to minimize the amount of steam required to remove wrinkles from the pants P disposed on the press unit 500, compared to the case in which the entire first chamber 100 is fully filled with steam. In addition, because it is possible to intensively apply heat only to the pants P, it is possible to save energy, compared to the case of dehumidifying and heating the entire air in the first chamber 100. In other words, it is possible to independently refresh the pants P using only the press unit 500 without activating the blower unit 220, the steam unit 250, or the heat pump unit 230, which are provided in the second chamber 200.

In this case, a user is able to remove wrinkles from only the pants P disposed on the press unit 500 and to clearly form intended creases, and the laundry treatment apparatus 1000 may provide the user with an additional management course for removal of wrinkles and formation of creases such that the user can select the course. In addition, it is possible to remove wrinkles from the pants P disposed on the press unit 500 by operating only the press unit 500 even when the door 400 is opened. In the conventional apparatus, in order to press only the pants P disposed on the presser 50, the laundry treatment apparatus 2000 must be operated after refreshed laundry is taken out of the first chamber 100, the pants P are disposed alone on the presser 50, and the door 400 is closed. Accordingly, the present disclosure is capable of overcoming this inconvenience.

In addition, because the conventional laundry treatment apparatus 2000 is constructed such that the presser 50 is rotated about only one side thereof to press pants, the conventional laundry treatment apparatus 2000 must be designed such that the presser 50 is rotatable about either of the two sides of the presser 500 to realize a reversible design. The reversible design is intended to allow the rotational direction of the presser to be changed depending on whether a user is right-handed or left-handed. However, because the press unit 500 is movable in the up-and-down direction of the door 400, there is no need to consider whether a user is right-handed or left-handed at the design stage.

The laundry hanger support 405 is used in a manner such that pants P are hung on the laundry hanger 403 and then the hook of the laundry hanger 403 is hung on the laundry hanger support 405. Because the laundry hanger support 405 is configured such that a lug, such as a hook, projects toward the first chamber 100 from the door inner plate 401, the laundry hanger 403 may be hung on the projecting lug. The laundry hanger 403 may be a typical pants hanger, and may hold the hems of the leg parts of the pants P in the state in which the leg parts are folded in forward and backward directions. Here, the pants P may be folded such that a clearly folded and intended crease, for example, a front crease of a bottom of a uniform or a bottom of a suit, is positioned at one side and a seam (or a stitch line) of the leg part of the bottom is positioned at the center, and may be held by the laundry hanger 403. Thereafter, the pants P may be hung on the laundry hanger support 405.

Accordingly, the roller 530 may be configured so as to be depressed at a portion thereof corresponding to the seams of the pants P rather than having a cylindrical form having a constant diameter such that the clearly folded and intended creases are pressed by the roller 530 but the seams are not pressed by the roller 530.

Because the hems of the pants P are held by the laundry hanger 403, a user hangs the pants P in the inverted state. Here, the waist portion of the pants P excluding the leg parts, that is, the portion between the waist line and the lower end of the hip portion, which is called a "rise", is typically heavier than the leg parts. Accordingly, when the pants P are suspended in the inverted and extended state, tensile force may be applied throughout the pants P due to the self-weight of the pants P. When tensile force is applied to the pants P, the pants P may be pulled in the height direction of the door 400 or in the longitudinal direction of the pants P.

The door 400 may be rotatably coupled to the cabinet 150 so as to open and close the entrance 120. To this end, the door 400 may include a fastening member such as a hinge unit (not shown). The door 400 may be composed of a single plate. The embodiment of the door 400 shown in FIG. 3 may include a door outer plate 4111 including an outer surface of the door 400, which is positioned far away from the first chamber 100, the door inner plate 401 positioned so as to face the first chamber 100, and a side surface 4112 connecting the door inner plate 401 to the door outer plate 4111. The outer surface of the door 400 may be provided with a display (not shown) configured to receive a selection signal from a user and to output the result and associated information. Wires (not shown) for connection to power and transmission of control signals may be disposed between the door inner plate 401 and the door outer plate 4111. The press unit 500 may be coupled to the door inner plate 401.

The door 400 may include the door inner plate 401 facing the first chamber 100, and a rear surface 4011, which is the one among the two surfaces of the door inner plate 401 that is farther away from the entrance 120. When the door 400 is opened, although the door inner surface 401 is exposed to the outside, the rear surface 4011 is not exposed to the outside because the rear surface 4011 is one of the surfaces defining the interior space in the door 400. Furthermore, the door inner plate 401 may include the rear surface 4011, which is positioned far away from the entrance 120, and an inner exposed surface, which is positioned close to the entrance 120.

The door inner plate 401 may include the door gasket 486 configured to form a seal between the door 400 and the cabinet 150, and the door liners 482 and 484, which are provided on the door inner plate 401 so as to guide condensed water, which is generated in the first chamber 100 when the door 400 is closed, to the first chamber bottom surface 101. In some embodiments, the door 400 may be configured to simultaneously open and close the first chamber 100 and the tank-mounting space 351. In another embodiment, a plurality of doors may be mounted on the cabinet 150, and the doors may respectively open and close the first chamber 100 and the tank-mounting space 351. The door liners 482 and 484 may be provided so as to face the first chamber 100 when the door 400 is closed, and may include the upper door liner 482 and the lower door liner 484. The door liners 482 and 484 may discharge condensed water, which is generated on the surfaces of the door liners 482 and 484, to the sump (not shown) disposed below the inlet duct through the air intake port 1013 provided in the first chamber bottom surface 101.

The door gasket 486 may be mounted on the door inner plate 401 so as to surround the door inner surface 401. The seal between the door 400 and the cabinet 150 may be established by the door gasket 486. The door gasket 486 may also separately seal the first chamber 100 and the tank-mounting space (not shown) in which is the water supply tank 310 and the water discharge tank 330 are mounted.

The base plate 510 may be coupled to the door inner plate 401 so as to support the pants P hung on the laundry hanger support 405. The base plate 510 may be coupled to the door inner plate 401 in the state of being spaced apart from the door inner plate 401. To this end, an elastic support (not shown) having elasticity may be positioned between the base plate 510 and the door inner plate 401. When the roller 530 presses the pants P toward the door inner plate 401, the elastic support may support the base plate 510 in order to bring the pants P into uniform and close contact with the base plate 510.

The upper portion and the lower portion of the base plate 510 may be curved. The upper portion of the base plate 510 refers to the portion of the base plate 510 that is closer to the laundry hanger support 405 than to a laundry holder 420, which will be described later, and the lower portion of the base plate 510 refers to the portion of the base plate 510 that is closer to the laundry holder 420 than to the laundry hanger support 405. The upper portion of the base plate 510 may support the hem portions of the pants P, whereas the lower portion of the base plate 510 may support the waist portion of the pants P.

In the pants P supported by the base plate 510, the portion of the pants P that is pressed by the roller 530 is the leg parts of the pants P. Because the waist portion of the pants P is provided with a zipper, a waist pocket and the like, it is difficult to press the waist portion using the roller 530, and moreover it is unnecessary to press the waist portion. Accordingly, because the laundry holder 420 is coupled to the lower portion of the door inner plate 401 and presses and holds opposite sides of the waist portion of the pants P, which are suspended in an inverted state, the laundry holder 420 may not interfere with the roller 530, which presses the leg parts of the pants P. Particularly, because the roller 530 removes wrinkles using steam or moisture and presses the pants P, it is possible to form a clearly formed and intended crease, for example, front creases in the pants P.

The remaining middle portion of the base plate 510 excluding the upper portion and the lower portions thereof may be positioned parallel to the door inner plate 401. Accordingly, the middle portion of the base plate 510 may be parallel to the portion of the door inner plate 401 that corresponds to the middle portion, and the upper and lower portions of the base plate 510 may be curved, and may thus become close to the door inner plate 401.

When the base plate 510 is viewed from a lateral side, the distance between the door inner plate 401 and the base plate 510, which is measured in a direction perpendicular to the door inner plate 401, may increase toward the middle portion from the upper portion of the base plate 510. Furthermore, the distance between the door inner plate 401 and the base plate 510 may increase toward the middle portion from the lower portion of the base plate 510. The reason for this is to more efficiently apply tensile force to the pants P. The laundry hanger support 405 may be positioned on the door inner plate 401, and downward tensile force may be applied to the pants P suspended from the laundry hanger support 405. Accordingly, in comparison with the case in which of the base plate 510 is flat, because the contact length and the contact area between the base plate 510 and the pants P increase in the case in which the base plate 510 is curved, the base plate 510 may be in closer contact with the pants P, thereby improving the effect of applying tensile force to the pants P.

Because the middle portion of the base plate 510 is maximally convex and the distance between the base plate 510 and the door inner plate 401 in a direction perpendicular to the door inner plate 401 decreases moving downwards, that is, toward the lower portion of the base plate 510 from the middle portion, the pants P may drop from the base plate 510. In order to prevent the pants P from dropping, the door 400 may further include the laundry holder 420, which is coupled to the door inner plate 401 and holds opposite sides of the waist portion of the suspended pants P. The laundry holder 420 may convey an effect of pulling the pants P in order to prevent opposite sides of the pants P from being spaced apart from the base plate 510. Consequently, by virtue of the laundry holder 420, tensile force may be applied to the pants P.

The laundry holder 420 may include a first laundry holder 421 configured to hold one side of the waist portion of the pants P and a second laundry holder 422 configured to hold the other side of the waist portion of the pants P. Here, the one side and the other side of the waist portion of the pants P mean opposite sides of the waist portion of the pants P in the state in which the leg parts are folded such that the seams (or stitch lines) of the leg parts are positioned at the centers of respective leg parts and the pants P are held by the laundry hanger 403.

Here, because the laundry holder 420 holds the opposite sides of the suspended pants P, the pants P may come into contact with the base plate 510 even when the pants P extend close to the lower end of the base plate 510 beyond the middle portion of the base plate 510. The laundry holder 420 may be configured to have a clamp structure in order to hold the opposite sides of the pants P. Alternatively, the laundry holder 420 shown in FIG. 3 may be configured to have the form of an angled beam. The laundry holder 420 may be coupled to the door inner plate 401, and may hold opposite sides of the pants P in the state in which the pants P are loosely inserted into the laundry holder 420. In other words, the laundry holder 420 is intended to prevent the pants P from coming into contact with the base plate 510 and being moved in rightward and leftward directions.

FIG. 4(*a*) illustrates the press unit 500 in an enlarged view. The press unit 500 may include the base plate 510 configured to support the pants P hung on the laundry hanger support 405, the rotating shaft 536 disposed in the width direction of the door 400, the roller 530, which is rotatable about the rotating shaft 536 and presses the pants P, and the moving unit 550, which is configured to support the rotating shaft 536 and to move the rotating shaft 536 and the roller 530 in the vertical direction of the door 400.

The roller 530 may include a first cylindrical press portion 531, which is positioned close to one end of the roller 530 and presses the pants P, a second cylindrical press portion 532, which is positioned close to the other end of the roller 530 and presses the pants P, and a cylindrical moisture supply 533, which is positioned between the first press portion 531 and the second press portion 532 so as to connect the first press portion 531 to the second press portion 532 and which supplies moisture to the pants P.

The roller 530 may be constructed such that the first press portion 531 and the second press portion 532, which press the pants P, and the moisture supply 533 are integrally formed. Accordingly, when the drive unit 540 (see FIG. 5) rotates the roller 530, the first press portion 531, the second press portion 532, and the moisture supply 533 may be rotated therewith.

Here, the roller 530 receives moisture from the moisture supply 533 and presses the pants P while pulling the pants P by means of the first press portion 531 and the second press portion 532, which is useful for removal of wrinkles and formation of clear creases.

Although the roller 530 may be made of any of a metal material, a wood material and a plastic material, it is preferable that the roller 530 be made of a metal material. In order to press laundry using the roller 530 and apply heat to the laundry using a heater in the manner of an iron, as will be described later, the roller 530 is preferably made of a metal material in consideration of hardness and thermal conductivity.

The roller 530 may include a roller body 5301 defining the appearance thereof, the first press portion 531 positioned close to one end of the roller body 5301, the second press portion 532 positioned close to the other end of the roller body 5301, and the moisture supply 533, which is positioned between the first press portion 531 and the second press portion 532 so as to connect the first press portion 531 to the second press portion 532 and supplies moisture to the pants P.

The roller 530 may be rotatable about the rotating shaft 536, which is disposed in the width direction of the door 400. The roller 530 may further include the moving unit 550, configured to move the roller 530 in the longitudinal direction of the door 400.

The diameter of the moisture supply 533 may be smaller than the diameter of the first press portion 531 and the second press portion 532. In an embodiment of the moisture supply 533 shown in FIG. 4(*a*), the outer circumferential surface of the moisture supply 533 may be provided therein with the plurality of steam spray holes 5331 for spraying steam.

When steam is sprayed through the plurality of steam spray holes 5331, the steam may permeate the pants P, which are pressed by the roller 530. Because the press unit 500 may include the steam generation tank 580 (see FIG. 8), which is provided in the moisture supply 533 and supplies steam, in addition to the steam unit 250 configured to spray steam to the laundry disposed in the first chamber 100, the press unit 500 may be accommodated in the first chamber 100, and may be operated independently of supply of steamed and/or dehumidified and heated air. In other words, it is possible to spray steam and apply heat to the suspended pants P while only the roller 530 is moved without operating the steam unit 250, the blower unit 220, or the heat pump unit 230, which are accommodated in the second chamber 200. For example, the press unit 500 may convey an effect like that which is obtained when a user uses a steam iron on an ironing board in order to remove wrinkles from the pants P.

If the diameter of the moisture supply 533 is equal to the diameter of the first press portion 531 or the second press portion 532, the moisture supply 533 may press the pants P to the same extent as that by the first press portion 531 or the second press portion 532. Here, because some of the plurality of steam spray holes 5331 that are in contact with the pants P are clogged by the pants P, steam may be discharged through those among the plurality of steam spray holes 5331 that are positioned opposite the some of the plurality of steam spray holes 5331 that re in contact with the pants P. Hence, it is impossible to spray steam to the pants P. In order to prevent this, the diameter of the moisture supply 533 may be smaller than the diameter of either of the first press portion 531 and the second press portion 532.

The regions of the pants P that correspond to the moisture supply 533 may be provided with seams or stitch lines. Pressing the seams or the stitch lines may cause warping of the pants P and thus formation of double creases. In order to avoid this problem, the diameter of the moisture supply 533 may be smaller than the diameter of either of the first press portion 531 and the second press portion 532.

Referring to an embodiment of the roller 530 shown in FIG. 4(*a*) and FIG. 4(*b*), the two ends of the roller 530 may be connected to the rotating shaft 536. The rotating shaft 536 provided at the two ends of the roller 530 may support the roller 530 via the moving unit 550.

Specifically, the rotating shaft 536 may include a first rotating shaft 5361 coupled to one end of the roller 530 and a second rotating shaft 5362 coupled to the other end of the roller 530.

The door 400 may further include guide holes 415, which are formed in the vertical direction of the door 400. The moving unit 550 may include a first transfer portion 5501 coupled to the first rotating shaft 5361 and a second transfer portion 5502 coupled to the second rotating shaft 5362, and the guide holes 415 may include a first guide hole 4151, which is positioned between one side surface of the base plate 510 and the side surface of the door 400 that is positioned close to the one side surface of the base plate 510, and a second guide hole 4152, which is positioned between the other side surface of the base plate 510 and the other side surface of the door 400, which is positioned close to the other side surface of the base plate 510.

The first transfer portion 5501 may be movable in the vertical direction of the door 400 along the first guide hole 4151 when the roller 530 is rotated, and the second transfer portion 5502 may be reciprocable in a vertical direction (in the direction of the arrow) along the second guide hole 4152 when the roller 530 is rotated.

FIG. 4(*c*) illustrates an embodiment of the press unit 500 when viewed from a lateral side. The door 400 may include the door inner surface 401 positioned so as to face the entrance 120, the rear surface 4011 of the door inner surface 401 positioned far away from the entrance 120, and the door outer plate 4111 coupled to the rear surface 4011 so as to define a mounting space 4115.

In other words, the door 400 may not be composed of a single plate, but may be an assembly in which multiple panels are coupled to each other. Specifically, the door 400 may include the door inner plate 401 positioned so as to face the entrance 120, and the door outer plate 4111, positioned farther away from the entrance 120 than the door inner plate 401. The door inner plate 401 and the door outer plate 4111 may define therein a predetermined mounting space 4115.

The mounting space 4115 may be provided therein with an electric wire, which is connected to the controller (not shown) so as to transmit and receive a control signal or supply power. The mounting space 4115 may be provided therein with a power supply 559 (see FIG. 7(*a*)) for rotation of the roller 530. Furthermore, the mounting space 4115 may be provided therein with a guide (not shown), which is configured to control an insertion depth, to which the moving unit 550 is moved along the guide hole, to thus control the distance between the roller 530 and the moving unit 550. The reason why the power supply 559 (see FIG. 76(*a*)) is provided in the mounting space 4115 or the interior space in the door 400 is to maximally prevent the power supply 559 (see FIG. 7(*a*)) from being exposed to moisture upon the supply of steam into the first chamber 100 or via the roller 530 and to provide a neat appearance.

Furthermore, the power supply 559 may supply power required not only for rotation of the roller 530 by the drive unit 540 but also for generation of moisture and/or steam from the moisture supply 533 and heating of the outer circumferential surface of the roller 530 by the first heater 5351 and the second heater 5352.

Referring to FIG. 4(*c*), when the roller 530 is rotated in a first rotation direction, for example, in a clockwise direction, while pressing the pants P, the roller 530 may be moved upwards. To this end, the rotating shaft 536 rotatably supporting the roller 530 and the moving unit 550 supporting the rotating shaft 536 may be respectively provided at the two ends of the roller 530. The moving unit 550 may be moved along the guide hole 415 in the vertical direction of the door 400. Here, a portion of the moving unit 550 may be inserted into the guide hole 415. In order to prevent the moving unit 550 from being separated from the guide hole 415, the moving unit 550 may include a wheel 554, which is oriented in the width direction of the door 400 and is wider than the width of the guide hole 415. Specifically, the wheel 554 may be configured as a small caster such that the moving unit 550 is movable along the guide hole 415. Accordingly, the moving unit 550 may be smoothly movable along the guide hole 415 in the vertical direction of the door 400 with reduced friction.

Although the moving unit 550 may be movable along the guide hole 415 by means of an additional drive device, the moving unit 550 according to the embodiment may be passively moved by rotation of the roller 530. In other words, the moving unit 550 may be moved upwards when the roller 530 is rotated in a first rotational direction and may be moved downwards when the roller 530 is rotated in a second rotational direction, opposite the first rotational direction, without using an additional drive device.

Here, the roller 530 may be rotated on the base plate 510 while pressing the pants P. An elastic member 552 (see FIG. 10(*b*)) may be provided between the roller 530 and the moving unit 550 so as to bias the roller 530 toward the base plate 510. Accordingly, even when the rotation of the roller 530 is halted, the roller 530 may be maintained in at a current position thereof while pressing the pants P without slipping on the pants P.

In other words, the moving unit 550 may be moved along the guide hole 415 in one direction among upward and downward directions when the roller 530 is rotated in the first rotational direction, and may be moved along the guide hole 415 in the direction opposite the one direction when the roller 530 is rotated in a second rotational direction opposite the first rotational direction. When the roller 530 is stopped, the moving unit 550 may also be stopped.

In practice, the moving unit 550 may be moved in the vertical direction of the door 400 by virtue of rotation of the roller 530, and may serve merely to guide the roller 530 along the guide hole 415.

Referring to FIG. 4(*c*), the base plate 510 may be configured such that the distance D1 between the door inner plate 401 and the base plate 510 in a direction perpendicular to the door inner plate 401 increases moving toward the middle portion from the upper portion of the base plate 510, as described above. Although the position of the moving unit 550, which is moved along the guide hole 415 formed in the door inner plate 401, may not vary, the position of the roller 530, which is moved on the base plate 510, may vary. Accordingly, the distance between the roller 530 and the moving unit 55 may increase toward the middle portion from the upper portion of the base plate 510. At this time, because the roller 530 is elastically biased toward the base plate 510 due to the elastic member 552 (see FIG. 10(*b*)), which is positioned between the roller 530 and the moving unit 550, the roller 530 may press the pants P.

FIG. 5 illustrates an embodiment in which power is supplied for rotation of the roller 951. The roller 951 may perform rotational movement, and may include the moisture supply, which is provided in the roller 951 and supplies moisture and/or steam to the suspended pants, and the heater, configured to heat the outer circumferential surface of the roller 951 to thus apply heat to the suspended pants. To this end, there may be a need to supply the electrical energy that is required to heat the outer circumferential surface of the roller 951 and to heat water by a heater, for example, a steam heater 5353 to thus generate steam. Accordingly, power may need to be supplied to the roller 530.

Power may be supplied to the roller 951 in various ways. For example, when the door 400 is open, the door inner plate 401 may be exposed to a user, and thus the roller 530 may be exposed to the outside. At this time, if the electrical wire connected to the roller 530 is exposed, the esthetic appearance may be deteriorated, and the electrical wire may be corroded and deformed due to the steam and hot air sprayed from the first chamber 100 or the roller 530. Furthermore, the electrical wire may break due to a mistake by a user. In addition, because some of the space in the first chamber 100 is occupied by the electrical wire, the space intended to accommodate laundry therein may be needlessly wasted.

In order to prevent these problems in advance, it is preferable that power be supplied to the roller 951 through the space between the door inner plate 401 and the door outer plate 4111, that is, the mount space 4115 defined in the door 400.

In other words, it is possible to supply power to the roller 530 from the rear surface 4011 via the moving unit 953 inserted into the guide hole 915. In an embodiment in which power is supplied to the moving unit, a thin and long electrical wire may be configured to be moved together with the moving unit 953, as illustrated in FIG. 5. Because the electrical wire must be designed in consideration of the longest extension thereof, when the moving unit 953 is moved along the guide hole 915 and is positioned at the upper portion of the guide hole 915, the electrical wire may have a curved shape, as illustrated in FIG. 5(*a*). Meanwhile, when the moving unit 953 is moved along the guide hole 915 and is positioned at the lower portion of the guide hole 915, the electrical wire may have an almost straight shape. When the moving unit 953 is positioned between the upper portion and the lower portion of the guide hole 915, as illustrated in FIG. 5(*b*), a portion of the electrical wire may have a curved shape in order to be connected to the moving unit 953.

In this case, the mount space is too narrow, and there is a high likelihood of the electrical wire becoming entangled upon repeated use. Accordingly there is a need to provide a design for preventing this risk.

FIG. 5(*a*) is a perspective view of the moving unit 550, which is inserted into the guide hole 415 formed through the door inner plate 401 when viewed from a lateral side. FIG. 5(*b*) is a view of the moving unit 550 when viewed from a lateral side.

Referring to FIG. 6(*a*), the door 400 may not be composed of a single plate, but may be an assembly in which multiple panels are assembled with each other. The door 400 may include the door inner plate 401, which is positioned so as to face the entrance 120. Furthermore, the door inner plate 401 may include the rear surface 4011, which is positioned far away from the entrance 120.

The guide hole 415 may be formed through the door inner plate 401. The guide hole 415 may be configured to have a rectangular shape, in which the length thereof in the vertical direction of the door 400 (in the direction of the arrow) is greater than the length thereof in the width direction of the door 400. The moving unit 550 may be moved along the guide hole 415 in the vertical direction of the door 400 when the roller 530 is rotated. When rotation of the roller 530 is halted, the roller 530 may be maintained in the current position.

In order for the roller 530 to press the pants P, the longitudinal length of the guide hole 415, along which the moving unit 550 is moved, may be almost equal to that of the base plate 510. However, because the laundry holder 420 holds the opposite sides of the waist portion of the pants P, the roller 530 is capable of moving over the length of the base plate 510, so the length of the guide hole 415 may be less than the length of the base plate 510.

Referring to FIG. 6(*a*) and FIG. 6(*b*), the moving unit 550 may include a moving mount 553, a portion of which is inserted into the guide hole 415 and which is moved in the vertical direction of the door 400, and a moving support 551, which is coupled to the moving mount 553 and supports the rotating shaft 536.

The moving unit 550 may further include the wheel 554, which is positioned parallel to the width direction of the door 400 and is coupled to the side of the moving mount 553 that is inserted into the guide hole 415. Because the length of the wheel 554 is greater than the length of the guide hole 415 in the width direction, it is possible to prevent the moving unit 550 from being separated from the guide hole 415.

The moving unit 550 may further include the elastic member 552 (see FIG. 10(*b*)), which is positioned between the moving support 551 and the moving mount 553 so as to provide external force that is required in order for the roller 530 to press the pants P.

The roller 530 may receive power via the power supply 559 (see FIG. 6) provided on the rear surface 4011. Because the roller 530 is exposed to the humidity on the door inner plate 401, the roller 530 may be disposed on the rear surface 4011 in order to prevent the power supply 559 (see FIG. 7) from being exposed to the humidity.

When power is supplied to the power supply 559, the roller 530 is capable of rotating about the rotating shaft 536. The drive unit 540 configured to rotate the roller 530 may include a motor. The drive unit 540 may be provided at a position M1 of the moving support 551 or a position M2 of the moving mount 553. The drive unit 540 may be constructed such that the motor directly rotates the roller 530. The drive unit 540 may further include a planet gear assembly or a pulley assembly, in addition to the motor. The drive unit 540 may be arranged in any manner, as long as the arrangement is capable of rotating the roller 530 at a predetermined speed. The drive unit 540 may be provided only at one end of the roller 530 or at both ends of the roller 530. When the drive unit 540 is provided both at both ends of the roller 530, there may be need to synchronize the rotational speed of the drive unit 540. The drive unit 540 may be controlled by the controller (not shown) provided in the laundry treatment apparatus 1000.

The roller 530 may be pressed not only by elasticity but also by the rotative force of the drive unit 540 while being actively rotated by the drive unit 540.

The wheel 554 may be coupled to the side of the moving mount 553 that is inserted into the guide hole 415. The wheel 554 may include a wheel shaft 5543, which is positioned parallel to the width direction of the door 400, and a wheel rotator 5544, which is coupled to the wheel shaft 5543 so as to allow the moving unit 550 to be smoothly moved along the guide hole 415 by reducing frictional force with the rear surface 4011.

The wheel 554 may include an upper wheel 554*a* and a lower wheel 554*b*, which are respectively coupled to the upper portion and the lower portion of the moving mount 553 in order to stably support the moving mount 553 via the rear surface 4011. Each of the upper wheel 554*a* and the lower wheel 554*b* may include the wheel shaft 5543 and the wheel rotator 5544.

FIGS. 7(*a*) to 7(*c*) illustrate the guide hole 415 and the power supply 559 when viewed from the rear surface 4011. Referring to FIG. 7(*a*), when the rotating shaft 536 includes a first rotating shaft 5361 coupled to one end of the roller 530 and a second rotating shaft 5362 coupled to the other end of the roller 530, the moving unit 550 may include the first transfer portion 5501 coupled to the first rotating shaft 5361 and the second transfer portion 5502 coupled to the second rotating shaft 5362, and the guide hole 415 may include the first guide hole 4151, which is positioned between one side surface of the base plate 510 and the side surface of the door 400 that is positioned close to the one surface of the base plate 510, and the second guide hole 4152, which is positioned between the other side surface of the base plate 510 and the other side surface of the door 400, which is positioned close to the other side surface of the base plate 510.

The power supply 559 may receive power from a machine compartment 200. Specifically, the power supply 559, which is provided in the door 400, and the machine compartment 200 may be connected to each other via an electric wire disposed in a communication hole, which is formed in the hinge portion of the door 200 or the edge of the door 200, where the door 200 meets the cabinet 150. Accordingly, even when the door 200 is opened, the electric wire is hidden from the outside for aesthetic purposes.

The first transfer portion 5501 may be movable along the first guide hole 4151 in the vertical direction of the door 400 when the roller 530 is rotated, and the second transfer portion 5502 may be reciprocated along the second guide hole 4152 in the vertical direction of the door 400 (in the direction of the arrow) when the roller 530 is rotated.

Here, the wheel 554 may include a first wheel 5541, coupled to the first transfer portion 5501, and a second wheel 5542, coupled to the second transfer portion 5502. Each of the first wheel 5541 and the second wheel 5542 may include a first upper wheel 5541*a* and a second lower wheel 554*b*. Each of the first upper wheel 5541*a* and the second lower wheel 554*b* may include the wheel shaft 5543, which is positioned parallel to the width direction of the door 400 and the wheel rotator 5544, which is coupled to the wheel shaft 5543 so as to allow the moving unit 550 to be smoothly moved along the guide hole 415 with reduced friction with the rear surface 4011.

The rear surface 4011 may be provided with the power supply 559, configured to supply power to the roller 530. In other words, it is possible to supply power, required for rotation of the roller 530, via the mounting space 4115 in the door 400.

In summary, the laundry treatment apparatus 1000 may include the cabinet 150 having the entrance 120 formed in one surface thereof, the first chamber 100, which is positioned in the cabinet 150 so as to receive laundry therein through the entrance 120, the second chamber 200, which is positioned below the first chamber 100 and defines a space isolated from the first chamber 100, the door 400, which has the mounting space 4115 therein and which is rotatably coupled to the cabinet 150 so as to open and close the entrance 120, the door inner plate 401 facing the entrance 120, the laundry hanger support 405, which is provided on the door inner plate 401 and on which the pants P are hung, the base plate 510, which is coupled to the door inner plate 401 so as to support the pants P suspended from the laundry hanger support 405, the guide hole 415, which is oriented in the vertical direction of the door 400 parallel to the base plate 510 and which is formed through the door inner plate 401 in a direction perpendicular both to the vertical direction and to the width direction of the door 400, the rotating shaft 536, which is disposed parallel to the width direction of the door 400, the roller 530, which is rotatable about the rotating shaft 536 and presses the pants P, the moving unit 550, which supports the rotating shaft 536 and moves the rotating shaft 536 and the roller 530 along the guide hole 415 in the vertical direction of the door 400, and the power supply 559, which is disposed in the mounting space 4115 and supplies power to the roller 530.

Referring to FIGS. 7(*b*) and 7(*c*) which respectively illustrate the first transfer portion 5501 and the second transfer 5502 in FIG. 7(*a*) in enlarged views, the power supply 559 may include a wire 5590, which is positioned along the guide hole 415 in the vertical direction of the door 400. When the guide hole 415 includes the first guide hole 4151 and the second guide hole 4152 at the two ends of the roller 530, the wire 5590 may include a first wire 5591 and a second wire 5592, which are respectively disposed along the first guide hole 4151 and the second guide hole 4152.

For example, the first wire 5591 and the second wire 5592 may be respectively disposed along the first guide hole 4151 and the second guide hole 4152 so as to be parallel to each other. The first wire 5591 may be disposed adjacent to the side surface of the first guide hole 4151 that is positioned far away from one side surface of the door close to the first guide hole 4151 in the vertical direction of the first guide hole 4151. Meanwhile, the second wire 5592 may be disposed adjacent to the side surface of the second guide hole 4152 that is positioned far away from the other side surface of the door close to the second guide hole 4151 in the vertical direction of the second guide hole 4152.

In other words, the first wire 5591 and the second wire 5592 may be respectively disposed along the first guide hole 4151 and the second guide hole 4152 to as to be parallel to each other like rails.

Accordingly, the power supply 559 may supply power required not only for rotation of the roller 530 by the drive unit 540 but also for generation of moisture and/or steam from the moisture supply 533 and heating of the outer circumferential surface of the roller 530 by a first heater 5351 and a second heater 5352, through the first wire 5591 and the second wire 5592 from the power supply 559.

In other words, in place of the wire connection shown in FIG. 5, it is possible to supply power to the roller 530 or the moving unit 550 via the first wire 5591 and the second wire 5592.

The moving mount 553 may include a moving contact 558 to be connected to the wire 5590, which is disposed on a mount body lower surface 5573, which is the surface of the moving mount on which the wheel 554 is positioned. The moving contact 558 may be configured to have a pin form, and may be made of a highly conductive material or an alloy thereof such as aluminum or copper, having high electrical conductivity.

When the wheel 554 is composed of the upper wheel 554*a* and the lower wheel 554*b*, the moving contact 558 may be positioned between the upper wheel 554*a* and the lower wheel 554*b* for stable contact. The current that flows through the moving contact 558 may be transmitted to the drive unit 540 for rotation of the roller 530. The current may also be used in the generation of steam and heating of the roller 530, which will be described later.

Negative current ((−) current) and positive current ((+) current) may be respectively connected to the first wire 5591 and the second wire 5592. Alternatively, positive current ((+) current) and negative current ((−) current) may also be respectively connected to the first wire 5591 and the second wire 5592. The roller 530 may be electrically connected to the first wire 5591 and the second wire 5592 so as to form a single circuit, and the circuit may be supplied with direct current. Although alternating current may also be used, it is desirable to use direct current in consideration of the size of the drive unit relative to the diameter of the roller and required torque.

The wire 5590 may be sheathed by a coating member made of an insulation material, and the coating member may be partially removed in the vertical direction of the door 400 such that the portion of the wire 5590 that is in contact with the moving contact 558 is exposed.

FIG. 7(*a*) illustrates the roller 530, which is positioned at the upper end of the guide hole 415. The position may be the initial position of the roller 530. An input unit may be positioned on the front surface of the door 400 for selection of operational courses so as to allow a user to select a course for operation of the press unit 500. The front surface of the door 400 may refer to the surface of the door 400 that is exposed when the door 40 closes the entrance 120.

The position at which the roller 530 is positioned prior to the operation of the press unit 500 may be set as an initial position. The initial position may be the upper end of the guide hole 415. The reason for this is because the incorrect generation of creases such as double creases is reduced in the case in which the roller 530 is reciprocated in the vertical direction of the door 400 from the lower ends of the leg parts of the pants P than in the case in which the roller 530 is reciprocated in the vertical direction of the door 400 from the waist portion of the pants P.

When a predetermined period of time for the course that is selected by a user lapses, the roller 530 may return to the initial position and stop. The reason for this is to eliminate the need to preferentially rearrange the roller 530 to the initial position before every use because the final position of the roller 530 varies at every termination of use.

Referring to FIGS. 7 and 10, it will be appreciated that components that perform the same function are positioned close to one side and the other side of the door 400. In other words, the guide hole 415 may include the first guide hole 4151 and the second guide hole 4152. Furthermore, the wire 5590 may include the first wire 5591 and the second wire 5592. Furthermore, the moving unit 550 may include the first transfer portion 5501 and the second transfer portion 5502 so as to respectively correspond to the first guide hole 4151 and the second guide hole 4152. Furthermore, the moving contact 558 may include a first contact 5581 and a second contact 5582, and the wheel 554 may include the first wheel 5541 and the second wheel 5542. The moving mount 553 may include a first transfer mount 5531 and a second transfer mount 5532, and a moving mount body 557 may include a first transfer mount body 5571 and a second transfer mount body 5572. The moving support 551 may include a first transfer support 5511 and a second transfer support 5512. In other words, components having the same function may be symmetrically disposed.

FIG. 8 illustrates the roller 530 when viewed from above. The roller 530 may include the roller body 5301 defining the appearance of the roller 530, a first press 531 positioned close to one end of the roller body 5301, a second press 532 positioned close to the other end of the roller body 5301, and the cylindrical moisture supply 533, which is positioned between the first press 531 and the second press 532 so as to connect the first press 531 to the second press 532 and supplies moisture to the pants P.

The roller 530 may be rotated about the rotating shaft 536, which is oriented in the width direction of the door 400. The roller 530 may include the moving unit 550 configured to enable the roller 530 to be moved in the longitudinal direction of the door 400.

Referring to an embodiment of the moisture supply 533 shown in FIG. 8, the moisture supply 533 may have a plurality of steam spray holes 5331 through which steam is sprayed to the outer circumferential surface of the moisture supply 533.

When steam is sprayed through the plurality of steam spray holes 5331, the steam may permeate the pants P, which are in the state of being pressed by the roller 530. Furthermore, because the moisture supply 533 may be provided therein with the steam generation tank 580 (see FIG. 9) for the supply of steam, in addition to the steam unit 250 configured to spray steam to the laundry disposed in the first chamber 100, the press unit 500 may be disposed in the first chamber 100, and may be operated independently of the supply of steamed and/or dehumidified and heated air. In other words, it is possible to spray steam and apply heat to the suspended pants P while only the roller 530 is moved without operating the steam unit 250, the blower unit 220, or the heat pump unit 230, which are received in the second chamber 200. For example, the press unit may convey an effect obtained when a user uses a steam iron on an ironing board in order to remove wrinkles.

Here, if the diameter of the moisture supply 533 is equal to the diameter of the first press 531 or the second press 532, the moisture supply 533 may press the suspended pants P to the same extent as the extent to which the first press 531 or the second press 532 presses the pants P. Here, because some of the plurality of steam holes 5331 that are in contact with the pants P are clogged by the pants P, steam may be discharged through others of the plurality of steam spray holes 5331, which are positioned opposite the some of the steam holes 5331. In this case, because it is impossible to achieve the object of spraying steam to the pants P, the diameter of the moisture supply 533 may be smaller than the diameter of any of the first press 531 and the second press 532 in order to overcome this problem.

The regions of the pants P corresponding to the moisture supply 533 may have seams or stitch lines. Pressing the seams or the stitch lines may cause warping of the pants P and formation of double creases. Therefore, in order to prevent these problems, the diameter of the moisture supply 533 may be smaller than the diameter of any of the first press 531 and the second press 532.

The roller 530 may be configured to have a shape similar to that of a dumbbell. In other words, the outer circumferential surface of a region of the roller 530, which corresponds to a predetermined length in the longitudinal direction of the rotating shaft 536 of the roller 530 or in the width direction of the door 400, may have a diameter less than that of the two ends of the roller 530. The reason for this is to provide a space that avoids stitch lines, which are positioned at the center line of suspended pants P and into which steam is sprayed.

The predetermined length may be Wr in FIG. 8. The roller 530 may include the moisture supply 533 in the region corresponding to the predetermined length Wr.

However, the shape of the roller 530 and the shape of the moisture supply 533 shown in FIG. 8 are only for illustrative purposes, and the roller 530 and the moisture supply 533 may have other shapes as long as they remain capable of spraying steam. For example, the diameter of the moisture supply 533 may be equal to the diameter of the first press 531 or the second press 532. In this case, the steam spray holes 5331, which are formed in the outer circumferential surface of the roller 530, which has a constant diameter, may be depressed radially inwards in order to ensure space into which to spray steam. In other words, the entire region of the moisture supply 533 is not depressed, and only the regions of the individual steam spray holes 5331 may be depressed. Also in this case, the portion of the outer circumferential surface of the roller 530 that corresponds to the stitch lines in the pants P may be depressed radially inwards in order to avoid interference with the stitch lines when the roller 530 presses the pants P. In other words, a V-shaped or U-shaped notch may be formed in the center of the outer circumferential surface of the roller 530 in order to prevent interference with the stitch lines.

The drive unit 540 configured to drive the roller 530 may be provided at one end of the roller 530. Alternatively, the drive unit 540 may be provided at any other position on the roller 530 as long as the drive unit 540 is capable of rotating the roller 530. FIG. 8 illustrates an embodiment in which the first transfer portion 5501 and the second transfer portion 5502 are coupled to the two ends of the roller 530. The drive unit 540 may be positioned in the first transfer portion 5501 or the second transfer portion 5502. For example, the drive unit 540 may be positioned at M1 or M2, and may generate rotative force required to rotate the roller 530 using power received from the power supply 559 via the moving contact 558.

The power supply 559 may supply power required not only for rotation of the roller 530 through the drive unit 540 but also for the moisture supply 533, the first heater 5351, and the second heater 5352.

The moisture supply 533 may be composed of a first moisture supply body 533*a* and a second moisture supply body 533*b*, which are coupled to each other. Furthermore, at least one of the first moisture supply body 533*a* or the second moisture supply body 533*b* may be separated from or coupled to the roller 530 or the roller body 5301. The reason for this is to ensure attachment and detachment of the steam generation tank 580 (see FIG. 9), which may be positioned in the moisture supply 533.

In other words, the moisture supply 533 may include the first moisture supply body 533*a* including a tank introduction port 120, through which the steam generation tank 580 is inserted into and separated from the inside of the moisture supply 533, and a second moisture supply body 533*b* coupled to the tank introduction port 120. It is preferable that the first moisture supply body 533*a* and the second moisture supply body 533*b* be coupled to each other with low friction.

FIG. 9(*a*) illustrates an embodiment in which the first heater 5351, the second heater 5352, and a steam heater 5353 are provided in the roller 530. As described above, the roller 530 is not intended merely to press the pants P. For efficient removal of wrinkles and efficient formation of intended creases, the roller 530 may spray steam while transmitting heat to the pants P.

For spraying steam, the moisture supply 533 may include the steam generation tank 580, which is positioned in the moisture supply 533 and discharges generated steam, the steam heater 5353, which is positioned in the steam generation tank 580 and heats the water stored in the steam generation tank 580, and the plurality of steam spray holes 5331 (see FIG. 8), which are formed throughout the outer circumferential surface of the moisture supply 533 in order to spray the steam, which is generated by the steam heater 5353 and is discharged from the steam generation tank 580, to the pants P.

The roller 530 may further include a tank connector 539 configured to allow the steam generation tank 580 to be coupled to one of the first press 531 and the second press 532 and the moisture supply 533 and to be separated therefrom.

Consequently, the distance between the steam generation tank 580 and the steam spray holes 5331 may be reduced, and the steam generation tank 580 may be detachably received in the roller 530 like a cartridge. Accordingly, it is possible to further simplify and shorten the flow passage compared to the case in which a water supply tank or a subsidiary tank is externally provided in order to supply water. Furthermore, because steam is sprayed only to the suspended pants P, it is possible to reduce the amount of steam that is required compared to the case in which steam is supplied throughout the first chamber 100.

The roller 530 may include a blocker configured to prevent the steam between the first press 531 and the moisture supply 533 and between the second press 532 and the moisture supply 533 from being discharged through the plurality of steam spray holes 5331 (see FIG. 8) and from leaking into the first press 531 and the second press 532. A first blocker 5371 may be positioned between the first press 531 and the moisture supply 533, and a second blocker 5372 may be positioned between the second press 532 and the moisture supply 533. The first blocker 5371 and the second blocker 5372 may be made of metal film or plastic film.

One of the first blocker 5371 and the second blocker 5372 may be provided with the tank connector 539 so as to be coupled to or separated from the steam generation tank 580.

Referring to FIG. 9(*c*), the steam generation tank 580 may include a steam generation tank body 583, and may further include a first cover 581 and a second cover 582 which close the two ends of the steam generation tank body 583. Furthermore, the steam generation tank 580 may include a first terminal 5851 and a second terminal 5852, which are electrically connected to one of the first cover 581 and the second cover 582. These may have shapes similar to terminals provided at an elongate fluorescent tube, which are fitted into a socket. When the first terminal 5851 and the second terminal 5852 are connected to the tank connector 539, which has a socket shape corresponding to the first terminal 5851 and the second terminal 5852, the steam generation tank 583 may be electrically connected to the tank connector 539 so as to activate the steam heater 5353, for example, a heater provided in the steam generation tank 580.

Unlike the steam generation tank 580, which is removably coupled to the tank connector like a kind of cartridge, the steam generation tank 580 may be connected to a water supply pipe, which receives water from the externally provided water supply tank 310 (see FIG. 1). Accordingly, the controller (not shown) may supply water through the water supply pipe when there is a need to supply water to the steam generation tank 580.

The steam heater 5353 may convert electricity into heat, and may boil the water stored in the steam generation tank 580 to generate steam. The generated steam may be discharged through steam dischargers 5811 and 5812, which are provided at the first cover or the second cover, and may in turn be discharged to the outside through the plurality of steam spray holes 5331, thereby being sprayed to the pants P.

The heater may be preferably composed of a coiled heater or a sheath heater. However, the heater may be embodied as any other kind of heater, as long as the heater is capable of heating the water stored in the steam generation tank 580. For example, the heater may include an inverter-type coil. In the case in which a steam generation pipe rather than the steam generation tank is provided, the steam generation pipe may be connected to the water supply tank 310, which is externally provided, such that the water is heated so as to generate steam while the water flows through the steam generation pipe.

The tank connector 539 may be rotated in a direction opposite the rotational direction of the roller 530. The reason for this is to immerse the steam heater 5353 into the water stored in the steam generation tank 580. The tank connector 539 may be embodied as a combination of gears. However, the steam heater 5353 may be provided on the inner circumferential surface of the steam generation tank 580, and the steam generation tank 580 may be rotated together with the roller 530.

The roller 530 may further include the heater 535 configured to transmit heat to the pants P to thus heat the pants P. The heater 535 may include the first heater 5352 configured to heat the first press 531 and the second heater 5352 configured to heat the second press 532. The heater 535 may be electrically connected to the steam heater 5353. The reason for this is for heater 535 to be electrically connected to the first wire 5591 and the second wire 5592.

The first heater 5351 may be provided in a coiled form along the inner circumferential surface of the first press. When the first heater 5351 is in contact with the inner circumferential surface of the first press 531, heat may be most efficiently transmitted. Alternatively, the first heater 5351 may be positioned in the first press 531 such that the heat emitted from the first heater 5351 heats the first press 531 in a thermal radiation manner.

The second heater 5352 may be provided in a coiled form along the inner circumferential surface of the second press 532. When the second heater 5352 is in contact with the inner circumferential surface of the second press 532, heat may be most efficiently transmitted. Alternatively, the second heater 5352 may be positioned in the second press 532 such that the heat emitted from the second heater 5352 heats the second press 532 in a thermal radiation manner. The second heater 5352 may perform heating in any manner, as long as it is possible to heat the second press 532 to thus transmit the heat to the pants P.

Considering that the first press 531 and the second press 532 are heated, it is desirable that the roller body 5301 be made of a metal material.

Referring to FIG. 8(*a*), the first heater 5351 and the second heater 5352 may be electrically connected, and the steam heater 5353 may dependently receive power via the moving unit. However, in consideration of economic efficiency, the first heater 5351, the second heater 5352, and the steam heater 5353 may be electrically and integrally connected to one another, as illustrated in FIG. 8(*b*). This is only an illustrative example, and the first heater 5351, the second heater 5352, and the steam heater 5353 may be electrically connected to one another in another manner so as to heat the first press 531 and the second press 532 and discharge steam through the moisture supply 533.

In place of a moisture supply 533 configured to spray steam through the steam spray holes 5331, the moisture supply 533 may include a moisture-containing porous portion wound around the outer circumferential surface of the moisture supply 533. The diameter of the outer circumferential surface of the moisture-containing portion may be equal to or greater than the diameter of the first press 531 and the second press 532 such that, when the roller 530 presses the pants P, the moisture-containing portion 5332 is squeezed, and thus the moisture contained therein is discharged to the outside.

However, because the steam permeates throughout the pants P due to the ability of the steam to permeate laundry even when the steam is sprayed only to a portion of the pants P, it is more desirable to spray steam using the steam spray holes 5331 and the steam generation tank 580 than using the moisture-containing portion (not shown).

FIG. 10 illustrates embodiments of the moving support 551 and the moving mount 553 in an enlarged view. The moving unit 550 may include the moving mount 553, which is inserted partway into the guide hole 415 and is moved in the vertical direction of the door 400, and the moving support 551 coupled to the moving mount 553 so as to support the rotating shaft.

Referring again to FIG. 10(*a*), the moving unit 550 may further include the wheel, which is positioned parallel to the width direction of the door 400 and is coupled to the mount body lower surface 5573, which is the surface of the moving mount 553 that is inserted into the guide hole 415.

The moving unit 550 may further include the elastic member 552, which is positioned between the moving support 551 and the moving mount 553 so as to provide elasticity such that the roller body 5301 presses the pants P.

Referring to FIG. 10(*b*), the moving unit 550 may include the moving mount body 557, which receives a portion of the moving support 551, and a support hole 5576, which is formed in the moving mount body 557 so as to open toward the first chamber 100 and exposes the remaining portion of the moving support 551 to the outside. The elastic member 552 may be accommodated in the moving mount body 557 so as to elastically connect a portion of the moving support 551 to the moving mount body 557.

For example, when the distance between the base plate 510 and the guide hole 415 in a perpendicular direction gradually increases, the distance between the roller 530 and the moving unit 550 may also increase. Specifically, the distance between the moving support 551 supporting the roller 530 and the moving mount may increase. In order to accommodate the distance variation, the elastic member 552 may be provided between the moving support 551 and the moving mount 553. Accordingly, when the distance between the roller 530 and the moving unit 550 increases, the elastic force caused by the elastic member 552 is exerted in the opposite direction, whereby the roller 530 presses the pants P disposed on the base plate 510.

Meanwhile, when the distance between the base plate 510 and the guide hole 415 in the perpendicular direction gradually decreases, the distance between the roller 530 and the moving unit 550 may decrease. Specifically, the distance between the moving support 551 supporting the roller 530 and the moving mount 553 may decrease. Accordingly, when the distance between the roller 530 and the moving unit 550 decreases, the elastic force caused by the elastic member 552 is exerted in the opposite direction, whereby the roller 530 does not press the pants P disposed on the base plate 510.

Using this principle, it is possible to cause the roller 530 to press or to release the pants P by controlling the distance between the base plate 510 and the door inner plate 401, the distance between the base plate 510 and the guide hole 415 formed in the door inner plate 401 or the distance between the guide 440, which will be described later, and the base plate 510. When there is a parallel arrangement of the base plate 510 and the door inner plate 401, the base plate 510 and the guide hole 415, or the guide 440 and the base plate 510, with a constant distant therebetween, the roller 530 may press the pants P with a constant force.

Referring to FIG. 10(*c*), the elastic member 552 may be accommodated in the moving mount 553. The moving mount 553 may include the moving mount body 557 defining the appearance of the moving mount 553. The moving mount body 557 may include the mount body lower surface 5573, which is inserted into the guide hole 415, a mount body upper surface 5573 positioned opposite the mount body lower surface 5573, and a mount body side surface 5575, which connects the mount body upper surface 5574 to the mount body lower surface 5573 to define an internal space therebetween. The mount body side surface 5575 may be fully or partially inserted into the guide hole 415 depending on the distance between the base plate 510 and the door inner plate 401, the distance between the base plate 510 and the guide hole 415 formed in the door inner plate 401, or the distance between the guide 440 and the base plate 510.

The moving support 551 may include a first support body 551*a*, which is inserted into the moving mount 553 and is connected to the elastic member 552, and a second support body 551*b*, which is connected to the first support body 551*a* so as to support the rotating shaft 536 and the roller 530.

The mount body upper surface 5574 may have a support hole 5576 formed therethrough. A portion of the moving support 551 may be received in the moving mount body 557 through the support hole 5576, and the remaining portion of the moving support 551 may project outwards from the support hole 5576, and may be connected to the rotating shaft 536.

The elastic member 552 may connect the portion of the moving support 551 that is received in the moving mount body 557 to the mount body upper surface 5574. Accordingly, when the distance between the moving support 551 and the moving mount 553 increases, the portion of the moving support 551 that is received in the moving mount body 557 may project outwards through the support hole 5576. Accordingly, because the elastic member 552 is compressed so as to push the moving support 551 in the opposite direction, the roller 530 may press the pants P disposed on the base plate 510.

In other words, when the first support body 551*a* is moved in the direction of the support hole 5576 and the roller 530 is moved far away from the moving unit 550 by the second support body 551*b*, the roller 530 may press the pants P by virtue of the elastic force of the elastic member 552.

To this end, the laundry treatment apparatus 1000 may include the cabinet 150 having the entrance 120 formed in a surface thereof, the first chamber 100, which is positioned in the cabinet 150 and receives laundry through the entrance 120, the second chamber 200, which is positioned below the first chamber 100 and defines a space isolated from the first chamber 100, the door 400 rotatably coupled to the cabinet 150 so as to open and close the entrance 120, the door inner plate 401 positioned on the surface of the door 400 that faces the first chamber 100, the laundry hanger support 405, which is provided on the door inner plate 401 and on which the pants P are hung, the base plate 510, which is coupled to the door inner plate 401 in the state of being spaced apart from the door inner plate 401 so as to support the pants P hung on the laundry hanger support 405, the guide hole 415 formed through the door inner plate 401 in the vertical direction of the door 400 and in a direction perpendicular both to the vertical direction and to the width direction of the door 400, the rotating shaft 536 positioned parallel to the width direction of the door 400, the roller 530, which is rotatable about the rotating shaft 536 and presses the pants P, the moving unit 550, which moves the roller 530 along the guide hole 415 while the roller 530 is rotated, and the elastic member 552, which is positioned in the moving unit 550 and is connected to the rotating shaft 536 so as to apply elastic force to the roller 530 toward the base plate 510 to press the pants P and to support the rotating shaft 536.

The position of the elastic member 552 will now be described in detail with reference to FIG. 10(*c*). The moving support 551 may include the first support body 551*a*, which is received in the moving mount 553 and is connected to the elastic member 552, and the second support body 551*b*, which is connected to the first support body 551*a* and supports the rotating shaft 536. The moving mount 553 may include the moving mount body 557 accommodating the first support body 551*a* therein, the mount body upper surface 5574 formed in the surface of the moving mount body 557 that faces the first chamber 100 for communication of the inside of the moving mount body 557 with the first chamber 100, and the support hole 5576 formed through the mount body upper surface 5574 so as to allow the first support body 551*a* to project outwards from the moving mount body 557. Here, the elastic member 552 may be positioned between the mount body upper surface 5574 and the first support body 551*a*.

Although the elastic member 552 may be positioned at any position as long as the elastic member 552 connects the moving support 551 to the moving mount 553, the elastic member 552 is preferably positioned in the moving mount 553 so as to realize a neat appearance and to minimize exposure to moisture.

The base plate 510 may merely be positioned parallel to the door inner plate 401 so as to always maintain a predetermined facing distance therebetween. Here, the elastic member 552 may always apply elastic force to the roller 530 to press the pants P.

The facing distance may be the distance between the base plate 510 and the door inner plate 401, or may be the distance between the door inner plate 401 and a point at which an imaginary line, which extends perpendicularly from the door inner plate 401, intersects the base plate 510. When the base plate 510 includes a curved surface, for example, when the intermediate portion of the base plate 510 is configured to be flat parallel to the door inner plate 401 so as to maintain a predetermined facing distance therebetween whereas the upper and lower portions of the base plate 510 are curved toward the door inner plate 401, it is possible to vary the facing distance between the base plate 510 and the door inner plate 401. In other words, when the roller 530 moves on the base plate 510 and the moving unit 550 moves along the guide hole 415 formed in the door inner plate 401 in the vertical direction of the door 400, the facing distance between the base plate 510 and the door inner plate 401 may vary and the distance between the roller 530 and the moving unit 550 may also vary. Specifically, the distance between the first support body 551*a* and the mount body upper surface 5574 may vary. Consequently, the length of the elastic member 552 positioned between the first support body 551*a* and the mount body upper surface 5574 may vary.

Here, the distance or the perpendicular distance means the distance between an arbitrary point of an object and a point of another object at which an imaginary line, which extends from the arbitrary point in a direction perpendicular both to the vertical direction and to the width direction of the door 400, meets the another object.

When the length of the elastic member 552 increases beyond the original length, that is, when the distance between the base plate 510 and the door inner plate 401 increases, the elastic force applied to the roller 530 may gradually increase. Accordingly, when the roller 530 on the base plate 510 is moved toward the intermediate portion of the base plate 510, the pressure applied to the pants P may gradually increase. Because the intermediate portion of the base plate 510 is spaced apart from the door inner plate 401 by a predetermined spacing distance, the roller 530 may press the pants P with a constant force. The spacing distance means a predetermined distance by which the base plate 510 is spaced apart from the door inner plate 552 such that the roller 530 presses the pants P by means of the elastic member 552. Accordingly, the distance may vary depending on the design.

Accordingly, because the elastic member 552 is positioned between the mount body upper surface 5574 and the first support body 501*a*, it is possible to apply force to the roller 530 in the direction of the base plate 510 when the distance between the door inner plate 401 and the base plate 510 is equal to or greater than a predetermined distance.

Because the distance between the base plate 510 and the door inner plate 401 decreases again moving toward the lower portion of the base plate 510, the force applied to the pants P by the roller 530 will decrease. The reason for this is because there is no need to press the lower portion of the base plate 510 because the lower portion of the base plate 510 corresponds to the waist portion of the pants P.

Accordingly, in the case in which the base plate 510 is designed so as to have a curved surface, it is possible to control the force applied to the pants P by the roller 530 while efficiently applying tensile force to the pants P as described above.

When the perpendicular distance between the base plate 510 and the guide hole 415 gradually increases, the distance between the roller 530 and the moving unit 550 increases. Specifically, the distance between the moving support 551 supporting the roller 530 and the moving mount 553 increases. The elastic member 552, which is capable of accommodating the distance variation, may be provided at the moving support 551 and the moving mount 553. Accordingly, when the distance between the roller 530 and the moving unit 550 increases, the elastic force of the elastic member 552 is exerted in the opposite direction, whereby the roller 530 is capable of pressing the pants P disposed on the base plate 510.

Meanwhile, when the distance between the base plate 510 and the guide hole 415 gradually decreases, the distance between the roller 530 and the moving unit 550 will decrease. Specifically, the distance between the moving unit 551 supporting the roller 530 and the moving mount 530 will decrease. Accordingly, when the distance between the roller 530 and the moving unit 550 decreases, the elastic force from the elastic member 552 is applied in the opposite direction, whereby the roller 530 does not press the pants P disposed on the base plate 510.

FIG. 11(*a*) illustrates an embodiment which includes a battery configured to supply power to the roller 530. FIG. 11(*b*) illustrates the roller 530 when viewed from a lateral side. FIG. 11(*c*) illustrates a plurality of charging points provided on the rear surface 4011. FIG. 7 illustrates an embodiment in which power for rotation of the roller 530 is supplied via the wire 5590, which is disposed along the guide hole 415. Unlike this embodiment, FIG. 11 illustrates an embodiment in which a battery-charging portion is disposed along the guide hole 415. The battery-charging portion 561 may be provided for stable supply of power. Alternatively, after the battery-charging portion 561 is charged by supplying power thereto, the roller 530 may be rotated by the battery-charging portion 561, steam may be generated by the moisture supply 533, and the roller 530 may be heated using the heaters 5351 and 5352.

When the roller 530 is moved along the guide hole 415 in the vertical direction of the door 400 and then reaches the battery-charging portion 561, the controller (not shown) may check the power remaining in the battery 560, and may charge the battery 560 via the battery-charging portion 561. Because the roller 530 stays only at the battery-charging portion 561 for a predetermined period of time, rotation of the roller 530 may be halted.

FIG. 11(*a*) illustrates an embodiment in which the batter 560, which is provided outside the roller 530, is supported by the moving unit and is moved together with the roller 530 by rotation of the roller 530. Referring to FIG. 11(*b*), the battery 560 may include a charging support 562, which connects the battery 560 to the moving support 551 and supports the battery 560, and a charging bumper 563 configured to prevent the charging support 562 from being rotated beyond a predetermined angle and to support the charging support 562.

FIG. 11(*c*) illustrates an embodiment in which the battery-charging portion 561 is disposed on the rear surface 4011 along the guide hole 415. The battery-charging portion 561 may include a first charging portion positioned at a first point P1, which is the upper end of the guide hole 415. The first charging portion may correspond to the initial position of the roller 530 described above, and may be necessary to charge the battery 560 when the press unit 500 is not used or to charge the roller 530 when positioned at the first charging portion. The charging portion 561 may be connected to the wire 5590 received in the mounting space 4115.

The battery-charging portion 561 may include at least one charging portion arranged along the guide hole 415. In other words, the battery-charging portion 561 may include a first charging portion positioned at the upper end of the guide hole 415, that is, the initial position, and a second charging portion positioned at the lower end of the guide hole 415 or at an intermediate position thereof. Alternatively, the battery-charging portion 561 may include a second charging portion at an intermediate point P2 and a third charging portion at a point P3, which are arranged along the guide hole 415, as illustrated in FIG. 10(*c*). When the roller 530 reaches each of the second charging portion and the third charging portion, the controller (not shown) may check the power remaining in the battery 560, and may charge the battery 560 for a predetermined period of time until the charging rate of the battery 560 drops to a predetermined rate in consideration of the remaining time of the current course.

Figure 12:
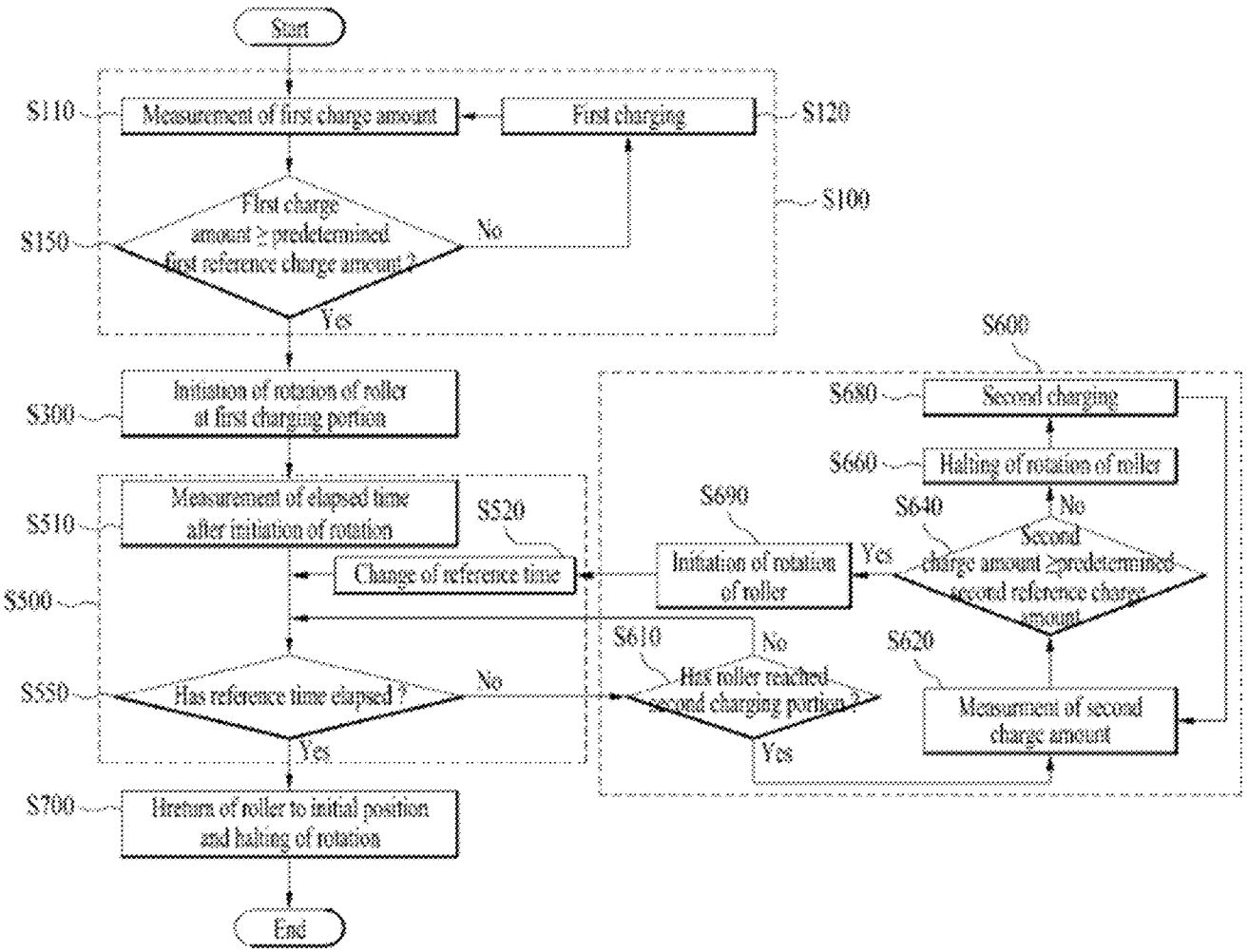
FIG. 12 is a flowchart illustrating an embodiment of a method of controlling the roller.

FIG. 12 illustrates an embodiment of a method of controlling supply of power to the roller 530. The method of controlling the supply of power according to the present disclosure may include an operation (S300) of initiating rotation of the roller 530 at the initial position, at which the roller 530 is positioned at the upper end of the guide hole 415, and an operation (S700) of returning the roller 530 to the initial position and halting rotation of the roller 530 when a predetermined period of time has elapsed since the operation (S300) of initiating rotation of the roller 530.

This method may be applied to any case such as the case in which power is continuously supplied to the roller 530 via the wire 5590 positioned on the rear surface 4011 while the roller 530 moves along the guide hole 415 and the case in which the roller 530 is rotated by the battery 560. In other words, regardless of how power is supplied, the roller 530 may begin to rotate at the initial position to press the suspended pants P, and may be returned to the initial position (S700) after completion of pressing. Subsequently, rotation of the roller 530 may be halted, thereby terminating the process of pressing the pants P.

The initial position may be the upper end of the guide hole 415 along which the roller 530 is moved. For example, the initial position may be the position of the first charging portion shown in FIG. 11(*c*). In other words, the initial position may be the portion of the guide hole 415 that is closest to the laundry hanger support 405. Specifically, the initial position may be the position of the charging portion, that is, the first charging portion, which is positioned at the highest level within the vertical range within which the roller 530 is movable.

The reason for this is because the formation of erroneous creases such as double creases is reduced in the case in which the roller is moved in the vertical direction of the door from the lower end of the leg parts of the pants P compared to the case in which the roller is moved in the vertical direction of the door from the waist portion of the pants P. Furthermore, the reason why the roller 530 is returned to the initial position after completion of the process is to avoid the cumbersome process of checking the position of the roller 530 by the controller (not shown) and moving the roller 530 to the initial position and then pressing the pants P.

When power is supplied in such a manner as to charge the battery 560, the battery-charging portion 561 may be disposed along the guide hole, as illustrated in FIG. 11(*c*). The first charging portion may be positioned at the initial position of the battery-charging portion 561. In order to minimize exposure of the battery-charging portion 561 to moisture, the battery-charging portion 561 may be positioned inside the door 400, that is, in the mount space 4115. The battery-charging portion may be preferably positioned on the rear surface 4011. The wire 5590 may be connected to the battery-charging portion 561 so as to supply power to the battery-charging portion 561.

When a user selects an operation of pressing the pants using the press unit 500, the controller may check the power remaining in the battery 560 prior to rotating the roller 530 (S100). In other words, the method according to the present disclosure may include a first measurement operation (S110) of measuring a first charge amount of the battery 560 prior to beginning to rotate the roller 530. Subsequently, the controller may determine whether the first charge amount is equal to or larger than a first reference charge amount (S150). When the first charge amount is equal to or larger than a first reference charge amount (Yes in S150), rotation of the roller 530 may be initiated. Meanwhile, when the first charge amount is smaller than the first reference charge amount (S150), the method may perform a first charging operation (S120) of charging the battery 560 until the battery 560 is charged to the first reference charge amount or more, without immediately initiating rotation of the roller 530. The reason for this is to prevent the battery 560 from being discharged and becoming immovable during rotation of the roller 530.

When the first charge amount is equal to or larger than a first reference charge amount (Yes in S150), the method according to the present disclosure may initiate rotation of the roller 530 (S300), and may then proceed to a pressing operation (S500). Assuming that the period of time required to perform the pressing operation (S500) is defined as a predetermined reference period of time, when the reference period of time has elapsed, the pressing operation (S500) may be performed for the reference period of time, and the roller 530 may be returned to the initial position and rotation thereof may be halted, thereby terminating the pressing operation. Subsequently, the controller may charge the battery 560 via the first charging portion for next use.

In order to determine whether the reference period of time has elapsed (S550), the method according to the present disclosure may initiate rotation of the roller 530 (S300), and may then measure the elapsed time (S510). Here, the reference period of time may be changed depending on the predetermined value or the charging time of the battery 560.

Because the roller 530 is reciprocated along the guide hole 415 during the pressing operation (S500), the roller 530 may pass through the battery-charging portion 561, which is disposed along the guide hole 415. Accordingly, the method according to the present disclosure may perform an intermediate checking operation (S600) of checking the power remaining in the battery whenever the roller passes through the battery-charging portion 561. When the amount of power remaining in the battery 560 is smaller than the amount of power required for the remaining pressing operation, the method according to the present disclosure may halt the rotation of the roller 530, and may charging the battery 560 at the battery-charging portion 561, to which the roller 530 moves.

Because the amount of power remaining in the battery 560 in the pressing operation (S500) may be different every time, the reference period of time required to perform the pressing operation (S500) may be adjusted in consideration thereof (S520).

To this end, the controller may determine whether the roller 530 reaches a new charging portion, for example, the second charging portion disposed along the guide hole 415 (S610), and may include a second measurement operation (S620) of measuring a second charge amount in the battery 560 when the roller 530 reaches a new charging portion, for example, the second charging portion disposed along the guide hole 415 (Yes in S610), and a second charging operation (S680) of charging the battery 560 via the battery-charging portion 561 which the roller 530 has reached when the second charge amount of the battery 560 is smaller than the predetermined second reference charge amount (No in S640).

In the intermediate checking operation (S600), the controller may determine whether the roller 530 reaches the battery-charging portion 561 (S610). When the roller 530 is determined to have reached the battery-charging portion 561, the method according to the present disclosure may measure the second charge amount, which is the power remaining in the battery 560 (S620). Thereafter, the controller may determine whether the second charge amount is equal to or larger than the predetermined second reference charge amount (S640). Here, when the second charge amount is smaller than the predetermined second reference charge amount (No in S640), the method may halt rotation of the roller 530 (S660), and may proceed to the second charging operation (S680) of charging the battery 560 until the battery 560 is charged to the second reference charge amount.

Alternatively, when the roller 530 reaches a new charging portion, the method according to the present disclosure may halt rotation of the roller 530, and may measure the second charge amount, which is the power currently remaining in the battery 560, in order to determine whether the battery has been charged.

This procedure is also applied when the roller 530 reaches the third charging portion. FIG. 24 illustrates an embodiment in which the first charging portion is positioned at the first point P1 and the second charging portion is positioned at the second point P2. Meanwhile, when the battery-charging portion 561 includes the third charging portion at point P3, the method may initiate rotation of the roller 530, and may repeatedly perform the pressing operation (S500) and the intermediate checking operation (S600). Here, the second charge amount may be changed to the third charge amount, and the predetermined second reference charge amount may be changed to the predetermined third charge amount. Furthermore, the second charging portion may be changed to the third charging portion, and the second charging may be changed to the third charging.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry treatment apparatus comprising:

a cabinet having an entrance defined at one surface thereof;

a first chamber defined in the cabinet and configured to receive laundry therein through the entrance;

a second chamber that is defined below the first chamber and is a space isolated from the first chamber;

a door having a mount space defined therein, the door being rotatably coupled to the cabinet and configured to open and close the entrance;

a door inner plate facing the entrance;

a laundry hanger support that is provided on the door inner plate and is configured to support pants hung thereon;

a base plate that is coupled to the door inner plate and configured to support the pants hung on the laundry hanger support;

a guide hole oriented parallel to the base plate in a vertical direction of the door and defined through the door inner plate in a direction perpendicular to the vertical direction and to a width direction of the door;

a rotating shaft that is parallel to the width direction of the door;

a roller configured to rotate about the rotating shaft and configured to press the pants;

a moving unit that supports the rotating shaft and is configured to move in the vertical direction of the door based on the roller being rotated; and a power supply that is disposed along and parallel to the guide hole and is accommodated in the mount space, the power supply being configured to supply power to the roller, wherein the moving unit comprises:

a moving mount that is partially inserted into the guide hole and electrically connected to the power supply, the moving mount being configured to move in the vertical direction of the door, and a moving support that is coupled to the moving mount and supports the rotating shaft.

2. The laundry treatment apparatus of claim 1, wherein the power supply is electrically connected to the moving unit and configured to supply the power to the roller even when the moving unit is moved along the guide hole by rotation of the roller.

3. The laundry treatment apparatus of claim 2, wherein the door inner plate has a rear surface facing an outside of the entrance, and wherein the door comprises a door outer plate that is coupled to the rear surface of the door inner plate and defines the mount space.

4. The laundry treatment apparatus of claim 3, wherein the moving mount includes a moving contact electrically connected to the power supply.

5. The laundry treatment apparatus of claim 4, wherein the moving unit includes a wheel that is provided in the width direction of the door and coupled to a side of the moving mount that is inserted into the guide hole, the wheel being configured to prevent the moving unit from being separated from the guide hole and configured to guide the moving unit in the vertical direction of the door.

6. The laundry treatment apparatus of claim 5, wherein the moving contact is coupled to the side of the moving mount on which the wheel is positioned.

7. The laundry treatment apparatus of claim 6, wherein the power supply includes a wire disposed along the guide hole in the vertical direction of the door.

8. The laundry treatment apparatus of claim 6, wherein the power supply includes a wire disposed on the rear surface of the door inner plate along the guide hole in the vertical direction of the door.

9. The laundry treatment apparatus of claim 8, wherein a part of the wire is wrapped by a coating member made of an insulation material, and wherein another part of the wire is not wrapped by the coating member and is configured to contact the moving contact.

10. The laundry treatment apparatus of claim 1, wherein the rotating shaft includes a first rotating shaft and a second rotating shaft that are coupled to two ends of the roller, wherein the moving unit includes a first transfer portion and a second transfer portion that are respectively coupled to the first rotating shaft and the second rotating shaft at the two ends of the roller, wherein the guide hole comprises:

a first guide hole into which the first transfer portion is inserted, and a second guide hole into which the second transfer portion is inserted, and wherein the first guide hole and the second guide hole are respectively defined in two side surfaces of the door inner plate and extend in the vertical direction of the door.

11. The laundry treatment apparatus of claim 10, wherein a distance between the first guide hole and the second guide hole is greater than a width of the base plate.

12. The laundry treatment apparatus of claim 11, wherein the power supply comprises:

a first wire electrically connected to the first transfer portion; and a second wire electrically connected to the second transfer portion, the first wire and the second wire being respectively disposed along the first guide hole and the second guide hole.

13. The laundry treatment apparatus of claim 12, wherein the first transfer portion includes a first contact to be electrically connected to the first wire, and the second transfer portion includes a second contact to be electrically connected to the second wire.

14. The laundry treatment apparatus of claim 1, wherein the power supply includes a battery configured to supply power required to rotate the roller.

15. The laundry treatment apparatus of claim 14, wherein the power supply further includes a battery-charging portion configured to charge the battery.

16. The laundry treatment apparatus of claim 15, wherein the door inner plate has a rear surface facing an outside of the entrance, wherein the door further comprises a door outer plate that is coupled to the rear surface of the door inner plate and defines the mount space, and wherein the battery-charging portion is positioned on the rear surface of the door inner plate along the guide hole.

17. The laundry treatment apparatus of claim 15, wherein the battery-charging portion includes a first charging portion positioned at an upper portion of the guide hole.

18. The laundry treatment apparatus of claim 1, wherein the roller comprises:

a first cylindrical press positioned close to one end of the roller and configured to press the pants;

a second cylindrical press positioned close to another end of the roller and configured to press the pants; and a cylindrical water supply that is positioned between the first cylindrical press and the second cylindrical press and connects the first cylindrical press and the second cylindrical press to each other, the cylindrical water supply being configured to provide moisture to the pants.

19. The laundry treatment apparatus of claim 18, wherein a diameter of the cylindrical water supply is smaller than a diameter of the first cylindrical press and the second cylindrical press.

20. The laundry treatment apparatus of claim 18, wherein the roller comprises:

a first heater disposed in the first cylindrical press and configured to heat the first cylindrical press; and a second heater disposed in the second cylindrical press and configured to heat the second cylindrical press.

21. The laundry treatment apparatus of claim 20, wherein the power supply is configured to, based on supplying the power to the roller, (i) rotate the roller, (ii) generate steam from the cylindrical water supply, and (iii) heat an outer circumferential surface of the roller by the first heater and the second heater.

22. The laundry treatment apparatus of claim 1, wherein a diameter of a central portion of the roller is smaller than a diameter of two ends of the roller.

* * * * *